US010756835B2

(12) United States Patent
Kwak et al.

(10) Patent No.: US 10,756,835 B2
(45) Date of Patent: Aug. 25, 2020

(54) METHOD AND DEVICE FOR TRANSMITTING AND RECEIVING BROADCAST SIGNAL FOR APPLICATION FILE FILTERING IN HYBRID BROADCAST SYSTEM

(71) Applicant: LG ELECTRONICS INC., Seoul (KR)

(72) Inventors: Minsung Kwak, Seoul (KR); Somi Park, Seoul (KR); Joonhee Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 63 days.

(21) Appl. No.: 15/868,490

(22) Filed: Jan. 11, 2018

(65) Prior Publication Data

US 2018/0227064 A1 Aug. 9, 2018

Related U.S. Application Data

(60) Provisional application No. 62/454,049, filed on Feb. 3, 2017, provisional application No. 62/470,798, filed on Mar. 13, 2017, provisional application No. 62/473,318, filed on Mar. 18, 2017.

(51) Int. Cl.

| | |
|---|---|
| ***H04H 60/07*** | (2008.01) |
| ***H04H 20/93*** | (2008.01) |
| ***H04H 60/73*** | (2008.01) |
| ***H04H 60/40*** | (2008.01) |

(52) U.S. Cl.

CPC ..... *H04H 60/07* (2013.01); *H04H 20/93* (2013.01); *H04H 60/40* (2013.01); *H04H 60/73* (2013.01)

(58) Field of Classification Search

None

See application file for complete search history.

(56) References Cited

U.S. PATENT DOCUMENTS

2016/0226611 A1 8/2016 Edge et al.

FOREIGN PATENT DOCUMENTS

| | | | |
|---|---|---|---|
| WO | 2016182358 | A1 | 11/2016 |
| WO | 2017006773 | A1 | 1/2017 |
| WO | 2017014586 | A1 | 1/2017 |

OTHER PUBLICATIONS

ATSC Candidate Standard: ATSC 3.0 Interactive Content—S34-230r1—Dec. 29, 2016 (Year: 2016).*

ATSC Candidate Standard: Signaling, Delivery, Synchronization, and Error Protection—S33-174r1—Jan. 5, 2016 (Year: 2016).*

ATSC candidate Standard: Application Signaling (A/337), Doc. S33-215r1, pp. 1-18, Jan. 19, 2017.

(Continued)

*Primary Examiner* — Peter Chen

*Assistant Examiner* — Jeff Banthrongsack

(74) *Attorney, Agent, or Firm* — Dentons US LLP

(57) ABSTRACT

The present invention proposes a method of transmitting a broadcast signal. The method of transmitting a broadcast signal according to the present invention provides a system capable of supporting next-generation broadcast services in an environment supporting next-generation hybrid broadcast using terrestrial broadcast networks and the Internet. In addition, an efficient signaling method for covering terrestrial broadcast networks and the Internet in an environment supporting next-generation hybrid broadcast is proposed.

10 Claims, 25 Drawing Sheets

(56) References Cited

OTHER PUBLICATIONS

ATSC candidate Standard: Signaling, Delivery, Synchronization, and Error Protection (A/331), Doc. S33-174r1, pp. 1-123, Jan. 5, 2016.
ATSC candidate Standard: ATSC 3.0 Interactive Content (A/344), S34-230r1, pp. 1-76, Dec. 29, 2016.
Guidelines for Implementation: DASH-IF Interoperability Point for ATSC 3.0, DASH Industry Forum, Version 1.0, pp. 1-66, Jan. 31, 2016.
ATSC candidate Standard: Application Signaling (A/337), Doc. S33-215r2, pp. 1-28, Apr. 19, 2017.
Yiling Xu et al., 'DASH and MMT and Their Applications in ATSC 3.0', ZTE Communications, vol. 14, No. 1, pp. 39-49, Feb. 2016.
ATSC, 'ATSC Standard: Signaling, Delivery, Synchronization, and Error Protection,' Doc. A/331:2017, Advanced Television Systems Committee, Washington, D.C., Dec. 6, 2017.

* cited by examiner

FIG. 3

| Syntax | No. of Bits | Format |
|---|---|---|
| LLS_table( ) { | | |
| LLS_table_id | 8 | uimsbf |
| provider_id | 8 | uimsbf |
| LLS_table_version | 8 | uimsbf |
| switch (LLS_table_id) { | | |
| case 0x01: | | |
| SLT | var | Sec. 6.3 |
| break; | | |
| case 0x02: | | |
| RRT | var | See Annex F |
| break; | | |
| case 0x03: | | |
| System Time | var | Sec. 6.4 |
| break; | | |
| case 0x04: | | |
| CAP | var | Sec. 6.5 |
| break; | | |
| default: | | |
| reserved | var | |
| } | | |
| } | | |

t3010 t3020

| Element or Attribute Name | Use | Data Type |
|---|---|---|
| SLT | | |
| @bsid | 1 | unsignedShort |
| @sltCapabilities | 0..1 | string |
| sltInetUrl | 0..1 | anyURL |
| @urlType | 1 | unsignedByte |
| Service | 1..N | |
| @serviceID | 1 | unsignedShort |
| @sltSvcSeqNum | 1 | unsignedByte |
| @protected | 0..1 | boolean |
| @majorChannelNo | 0..1 | 1...999 |
| @minorChannelNo | 0..1 | 1...999 |
| @serviceCategory | 1 | unsignedByte |
| @shortServiceName | 0..1 | string |
| @hidden | 0..1 | boolean |
| @broadbandAccessRequired | 0..1 | boolean |
| @svcCapabilities | 0..1 | string |
| BroadcastSvcCignaling | 0..1 | |
| @slsProtocol | 1 | unsignedByte |
| @slsMajorProtocolVersion | 1 | unsignedByte |
| @slsMinorProtocolVersion | 1 | unsignedByte |
| @slsPlpID | 0..1 | unsignedByte |
| @slsDestinationIpAddress | 1 | string |
| @slsDestinationUdpPort | 1 | unsignedShort |
| @slsSourceIpAddress | 1 | string |
| svcInetUrl | 0..N | anyURL |
| @urlType | 1 | unsignedByte |

FIG. 4

| Element or Attribute Name | Use | Data Type |
|---|---|---|
| bundleDescription | | |
| userServiceDescription | | |
| @globalServiceID | 1 | anyURL |
| @serviceID | 1 | unsignedShort |
| @serviceStatus | 0..1 | boolean |
| @fullMPDUri | 1 | anyURL |
| @sTSIDUri | 1 | anyURL |
| name | 0..N | string |
| @lang | 1 | language |
| serviceLanguage | 0..N | language |
| capabilityCode | 0..1 | string |
| deliveryMethod | 1..N | |
| broadcastAppService | 1..N | |
| basePattern | 1..N | string |
| unicastAppService | 0..N | |
| basePattern | 1..N | string |

t4010

| Element or Attribute Name | Use | Data Type |
|---|---|---|
| S-TSID | | |
| @serviceID | 1 | unsignedShort |
| RS | 1..N | |
| @bsid | 0..1 | unsignedShort |
| @slpAddr | 0..1 | string |
| @dIpAddr | 0..1 | string |
| @dport | 0..1 | unsignedShort |
| @PLPID | 0..1 | unsignedByte |
| LS | 1..N | |
| @tsi | 1 | unsignedInt |
| @PLPID | 0..1 | unsignedByte |
| @bw | 0..1 | unsignedInt |
| @startTime | 0..1 | dateTime |
| @endTime | 0..1 | dateTime |
| ScrFlow | 0..1 | scrFlowType |
| RepairFlow | 0..1 | rprFlowType |

t4020

FIG. 5

| Element or Attribute Name | Use |
|---|---|
| bundleDescription | |
| userServiceDescription | |
| @globalServiceID | M |
| @serviceID | M |
| Name | 0..N |
| @lang | CM |
| serviceLanguage | 0..N |
| contentAdvisoryRating | 0..1 |
| Channel | 1 |
| @serviceGenre | 0..1 |
| @serviceIcon | 1 |
| ServiceDescription | 0..N |
| @serviceDescrText | 1 |
| @serviceDescrLang | 0..1 |
| mpuComponent | 0..1 |
| @mmtPackageId | 1 |
| @nextMmtPackageId | 0..1 |
| routeComponent | 0..1 |
| @sTSIDUri | 1 |
| @sTSIDDestinationIpAddress | 0..1 |
| @sTSIDDestinationUdpPort | 1 |
| @sTSIDSourceIpAddress | 1 |
| @sTSIDMajorProtocolVersion | 0..1 |
| @sTSIDMinorProtocolVersion | 0..1 |
| broadbandComponent | 0..1 |
| @fullMPDUri | 1 |
| ComponentInfo | 1..N |
| @ComponentType | 1 |
| @ComponentRole | 1 |
| @ComponentProtectedFlag | 0..1 |
| @ComponentId | 1 |
| @ComponentName | 0..1 |

FIG. 6
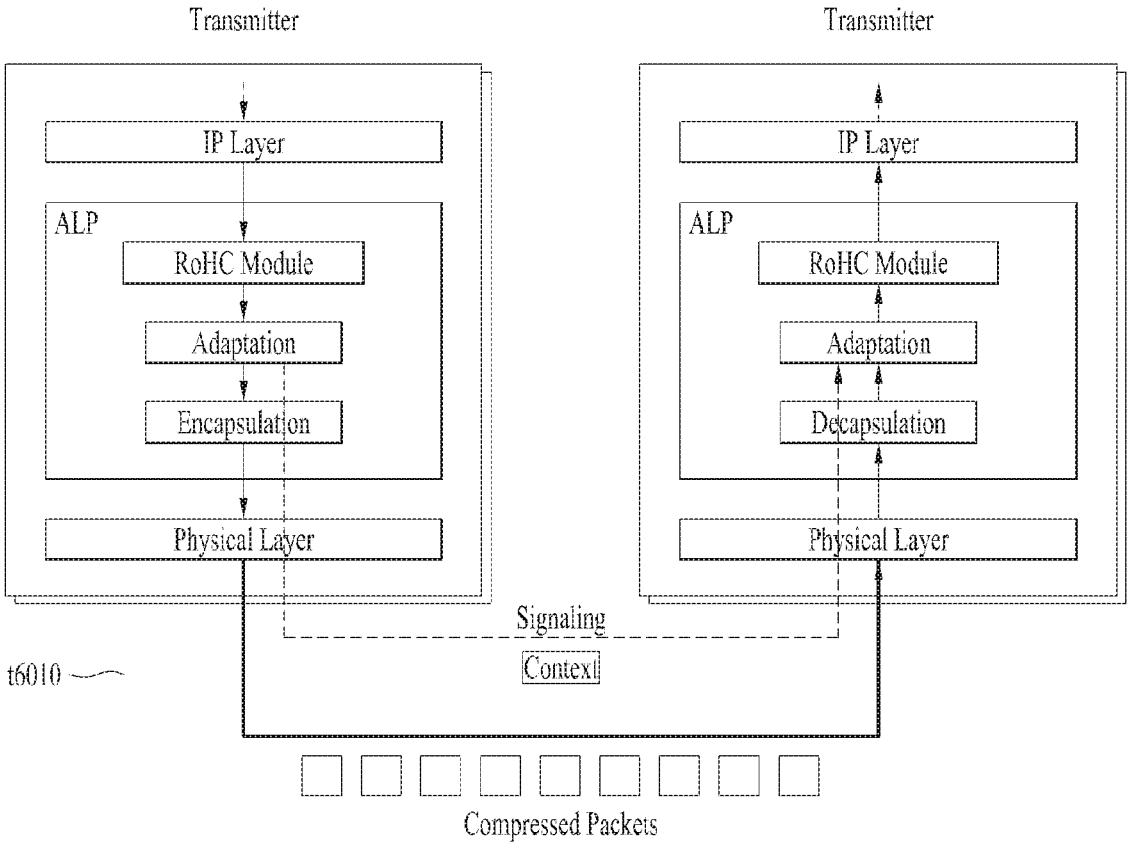
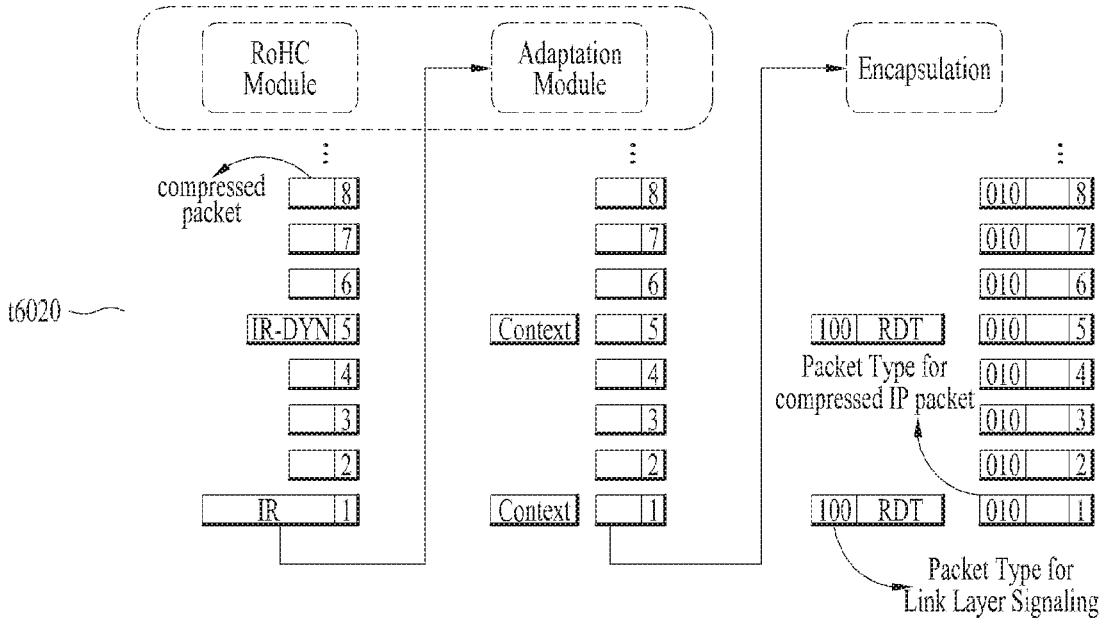

FIG. 7

| Syntax | Number of bits | Format |
|---|---|---|
| Link_Mapping_Table() { | | |
| signaling_type | 8 | 0x01 |
| PLP_ID | 6 | uimsbf |
| reserved | 2 | "11" |
| num_session | 8 | uimsbf |
| for(i = 0 ; i < num_session ; i + +) { | | |
| src_IP_add | 32 | uimsbf |
| dst_IP_add | 32 | uimsbf |
| src_UDP_port | 16 | uimsbf |
| dst_UDP_port | 16 | uimsbf |
| SID_flag | 1 | bslbf |
| compressed_flag | 1 | bslbf |
| reserved | 6 | '111111' |
| if (SID_flag = = "1") { | | |
| SID | 8 | uimsbf |
| } | | |
| if (compressed_flag = = "1") { | | |
| context_id | 8 | uimsbf |
| } | | |
| } | | |
| } | | |

FIG. 11

| | | | |
|---|---|---|---|
| HELD | 1 | | Includes HTML entry page collection elements. |
| HTMLEntryPage | 1..N | | Contains properties of the entry page. |
| @appContextID | 1 | anyURI | Defines the Application Context Identifier for this entry page. |
| @requiredCapabilities | 0..1 | string | Device capabilities needed for meaningful rendition of the entry page (as defined in the A/332, "Service Announcement") |
| @appRendering | 0..1 | boolean | For a linear service, indicates a broadcaster request that the broadcaster application be allowed to render the presentable component(s) of the Service |
| @entryURL | 1 | anyURI | URL of the entry page of the application |
| @alternateEntryURL | 0..1 | anyURI | An alternate broadband path to the same HTML page indicated in @entryURL. |
| @packageURL | 0..1 | anyURI | Indicates, if present, the URL of a package containing the entry page, which has the Content-Location value given in @entryURL |
| @validFrom | 0..1 | dateTime | Indicates that the page at @entryURL is to be loaded at the date and time of @validFrom, or at any time after the date and time of @validFrom and before the date and time of @validUntil when the service is selected. |
| @validUntil | 0..1 | dateTime | Indicates that application at @entryURL is to be unloaded at the date and time of @validUntil. |
| @coupledServices | 0..1 | held:listOfUnsignedshort | Provides a space-separated list of linear services sharing a common broadcaster application. |
| LCT | 0..N | | LCT channel which carries application-related files, such as an application entry page, files associated with the entry page, media assets expected to be consumed by the application, or packages of these files. |
| @tsiRef | 1 | unsignedInt | TSI value of an LCT channel |
| DistributionWindow | 0..N | | Broadcast transmission interval of application-related files. |
| @distWindowID | 1 | unsignedInt | A unique unsigned integer to identify this Distribution Window. The scope of uniqueness is for a given broadcaster within a given time frame. |
| @startTime | 1 | dateTime | Start time of the parent instance of DistributionWindow |
| @endTime | 1 | dateTime | End time of the parent instance of DistributionWindow |
| @dwFilterCode | 0..1 | held:listOfunsignedByte | A white-space-separated list of integers associated with application content item(s) broadcast during the affiliated instance of DistributionWindow. The meaning of each filter code integer is proprietary to the broadcaster. The list of filter codes that are germane to a given device can be retrieved by GetdwFiltersAPI() defined in A/344 [ref]. |
| @dwFCexpire | 0..1 | dateTime | Expiration date/time for @dwFilterCode |
| FileURL | 1..N | anyURI | URL of the application-related document to be delivered during the parent instance of DistributionWindow |
| @fileFilterCode | 0..1 | held:listOfunsignedByte | A white-space-separated list of integers representing filter codes that apply to this file. The list of filter codes that are germane to a given device can be retrieved by GetFileFiltersAPI() defined in A/344 [ref]. |
| @fileFCexpire | 0..1 | dateTime | Expiration date/time for @fileFilterCode |

FIG. 12

```
<HELD>
  <HTMLEntryPage appContextID="A.xyz.com" entryUrl="/p1/index.html" validUntil="2016-07-17T09:30:47Z">
            <LCT tsiRef="10">
            <DistributionWindow startTime="2016-07-17T00:00:00Z" endTime="2016-07-17T00:15:00Z"
                        distWindowID="100" dwFilterCode="3 8 11" />
            </DistributionWindow >
            <DistributionWindow startTime="2016-07-17T00:00:00Z" endTime="2016-07-17T00:15:00Z"
                        distWindowID="200" dwFilterCode="5 8 17" />
                        <FileURL fileFilterCode="5" >image/logo1.jpg</FileURL>
                        <FileURL fileFilterCode="8" >movie/logo2.mp4</FileURL>
                        <FileURL fileFilterCode="17" >movie/logo3.mp4</FileURL>
            </DistributionWindow >
            </LCT>
  </HTMLEntryPage>
  <HTMLEntryPage appContextID="A.xyz.com" entryUrl="/p2/index.html" validFrom="2016-07-17T09:30:47Z"
          validUntil="2016-07-17T12:00:47Z">
  </HTMLEntryPage>
<HELD>
```

FIG. 13

```
<DWD>
        <DistributionWindow startTime="2016-07-17T12:00:47Z" endTime="2016-07-18T12:
47Z" lctTSIRef="43 44">
                <AppContextId>A.xyz.com</AppContextId>
        </DistributionWindow>
</DWD>
```

L13010

```
</DWD>
        <DistributionWindow appContentLabel="1" startTime="2016-07-17T12:00:47Z" end
endTime="2016-07-18T12:00:47Z" lctTSIRef="43 44">
                <AppContextId>A.xyz.com</AppContextId>
        </DistributionWindow>
        <DistributionWindow appContentLabel="2" startTime="2016-07-18T12:00:47Z" end
Time="2016-07-19T12:00:47Z" lctTSIRef="43 44">
                <AppContextId>A.xyz.com</AppContextId>
        </DistributionWindow>
        <DistributionWindow appContentLabel="1" startTime="2016-07-19T12:00:47Z" end
Time="2016-07-20T12:00:47Z" lctTSIRef="43 44">
                <AppContextId>A.xyz.com</AppContextId>
        </DistributionWindow>
                <DistributionWindow appContentLabel="2" startTime="2016-07-20T
12:00:47Z" endTime="2016-07-21T12:00:47Z" lctTSIRef="43 44">
                <AppContextId>A.xyz.com</AppContextId>
        </DistributionWindow>
</DWD>
```

L13020

```
</DWD>
        <DistributionWindow appContentLabel="1" startTime="2016-07-17T12:00:47Z" end
endTime="2016-07-18T12:00:47Z" lctTSIRef="43 44">
                <AppContextId dwFilterCode="1 2 3" >A.xyz.com</AppContextId>
        </DistributionWindow>
        <DistributionWindow appContentLabel="1" startTime="2016-07-18T12:00:47Z" end
Time="2016-07-19T12:00:47Z" lctTSIRef="43 44">
                <AppContextId dwFilterCode="1 2 3" >A.xyz.com</AppContextId>
        </DistributionWindow>
        <DistributionWindow appContentLabel="2" startTime="2016-07-18T12:00:47Z" end
Time="2016-07-19T12:00:47Z" lctTSIRef="45 46">
                <AppContextId dwFilterCode="4 5 6" >A.xyz.com</AppContextId>
        </DistributionWindow>
</DWD>
```

L13030

FIG. 18

DWD (TSI = 0)

DistributionWindow
@appContentLabel (1234)
@startTime (2017-03-07T00:00:00)
@endTime (2017-03-07T12:00:00)
@tsiRef (300)
AppContextID (abc.com)
@dwFiterCode (1 2)
AppContextID (xyz.com)
@dwFiterCode (1 2)

DistributionWindow
@appContentLabel (5678)
@startTime (2017-03-08T00:00:00)
@endTime (2017-03-08T12:00:00)
@tsiRef (400)
AppContextID (abc.com)
@dwFiterCode (1 3)
AppContextID (xyz.com)
@dwFiterCode (1 3)

Receiver

② Receiver stores Filter Codes information into their own cache.

Filter Codes DB

| Index | Filter code | ··· | AppContextID | Expiration | Filter-in |
|---|---|---|---|---|---|
| 0 | 1 | ··· | abc.com | Indefinite | FALSE |
| 1 | 2 | | abc.com | Indefinite | FALSE |
| 2 | 3 | | abc.com | Indefinite | FALSE |
| 3 | 1 | | xyz.com | Indefinite | FALSE |
| 4 | 2 | ··· | xyz.com | Indefinite | FALSE |
| 5 | 3 | ··· | xyz.com | Indefinite | FALSE |

③ BA does personalization filtering evaluation with "Filter Codes DB".

| de | ··· | AppContextID | Expiration | Filter-in |
|---|---|---|---|---|
| | ··· | abc.com | Indefinite | FALSE |
| | | abc.com | Indefinite | FALSE |
| | | abc.com | Indefinite | FALSE |
| 3 | 1 | xyz.com | Indefinite | FALSE |
| 4 | 2 | ··· xyz.com | Indefinite | FALSE |
| 5 | 3 | ··· xyz.com | 2017-09-07 | TRUE |

④ BA requests to set filter code(s) to "TRUE" (as filter-in) or "FALSE" (as filter-out).
SetFilterAPI (appContextID, FilterCode[], boolean, expiration);
ex) SetFilterAPI ("xyz.com", "3", "TRUE", "2017-09-07");

⑤ Receiver decides whether any filtered-in files are delivered during a Distribution Window.

① Receiver stores Distribution Window information into their own cache.

Distribution Window DB

| Index | appContent Label | ··· | start | end | AppContextID &FilterCode | Open DW |
|---|---|---|---|---|---|---|
| 0 | 1234 | ··· | 2017-03-07 T00:00:00 | 2017-03-07 T12:00:00 | abc.com (1,2) xyz.com (1, 2) | FALSE |
| 1 | 5678 | ··· | 2017-03-08 T00:00:00 | 2017-03-08 T00:00:00 | abc.com (1,3) xyz.com (1, 3) | FALSE |

| nd | AppContextID &FilterCode | Open DW |
|---|---|---|
| 03-07 | abc.com (1,2) xyz.com (1, 2) | FALSE |
| | abc.com (1,3) xyz.com (1, 3) | TRUE |

| | | | | | | |
|---|---|---|---|---|---|---|
| 0 | 1234 | ··· | T00:00:00 | T12:00:00 | abc.com (1,2) xyz.com (1, 2) | FALSE |
| 1 | 5678 | ··· | 2017-03-08 T00:00:00 | 2017-03-08 T00:00:00 | abc.com (1,3) xyz.com (1, 3) | TRUE |

METHOD AND DEVICE FOR TRANSMITTING AND RECEIVING BROADCAST SIGNAL FOR APPLICATION FILE FILTERING IN HYBRID BROADCAST SYSTEM

This application claims the benefit of US provisional application Nos. 62/454,049, fined on Feb. 3, 2017, 62/470,798, filed on Mar. 13, 2017 and 62/473,318 field on Mar. 18, 2017, which are hereby incorporated by reference as if fully set forth herein.

BACKGROUND OF THE INVENTION

Field of the Invention

The present invention relates to a broadcast signal transmission device, a broadcast signal reception device, and broadcast transmission and reception methods.

Discussion of the Related Art

As analog broadcast signal transmission comes to an end, various technologies for transmitting/receiving digital broadcast signals are being developed. A digital broadcast signal may include a larger amount of video/audio data than an analog broadcast signal and further include various types of additional data in addition to the video/audio data.

That is, a digital broadcast system can provide HD (high definition) images, multichannel audio and various additional services. However, data transmission efficiency for transmission of large amounts of data, robustness of transmission/reception networks and network flexibility in consideration of mobile reception equipment need to be improved for digital broadcast.

SUMMARY OF THE INVENTION

The present invention provides a system capable of effectively supporting future broadcast services in an environment supporting future hybrid broadcasting using terrestrial broadcast networks and the Internet and related signaling methods.

The present invention can provide a method of transmitting an application file in a ROUTE protocol.

The present invention can provide a method of acquiring an application file in the ROUTE protocol The present invention can provide a transmission schedule of an application file to be transmitted through broadcasting.

The present invention can provide a method of transmitting a customized application file in consideration of user characteristics.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 3 is a diagram showing a low level signaling (LLS) table and a service list table (SLT) according to an embodiment of the present invention;

FIG. 4 is a diagram showing a USBD and an S-TSID delivered through ROUTE according to an embodiment of the present invention;

FIG. 5 is a diagram showing a USBD delivered through an MMT according to an embodiment of the present invention;

FIG. 6 is a diagram showing link layer operation according to an embodiment of the present invention;

FIG. 7 is a diagram showing a link mapping table (LMT) according to an embodiment of the present invention;

FIG. 11 is a diagram showing HTML-Enabled Location Description (HELD) according to an embodiment of the present invention;

FIG. 12 is a diagram showing a usage example of the HELD according to an embodiment of the present invention;

FIG. 13 is a diagram showing a configuration of a usage example of a distribution window description (DWD) according to an embodiment of the present invention;

FIG. 18 is a diagram showing an operation of a receiver using HELD, DWD and EFDT according to another embodiment of the present invention;

DETAILED DESCRIPTION OF THE INVENTION

The present invention provides apparatuses and methods for transmitting and receiving broadcast signals for future broadcast services. Future broadcast services according to an embodiment of the present invention include a terrestrial broadcast service, a mobile broadcast service, an ultra high definition television (UHDTV) service, etc. The present invention may process broadcast signals for the future broadcast services through non-MIMO (Multiple Input Multiple Output) or MIMO according to one embodiment. A non-MIMO scheme according to an embodiment of the present invention may include a MISO (Multiple Input Single Output) scheme, a SISO (Single Input Single Output) scheme, etc.

Figure 1:
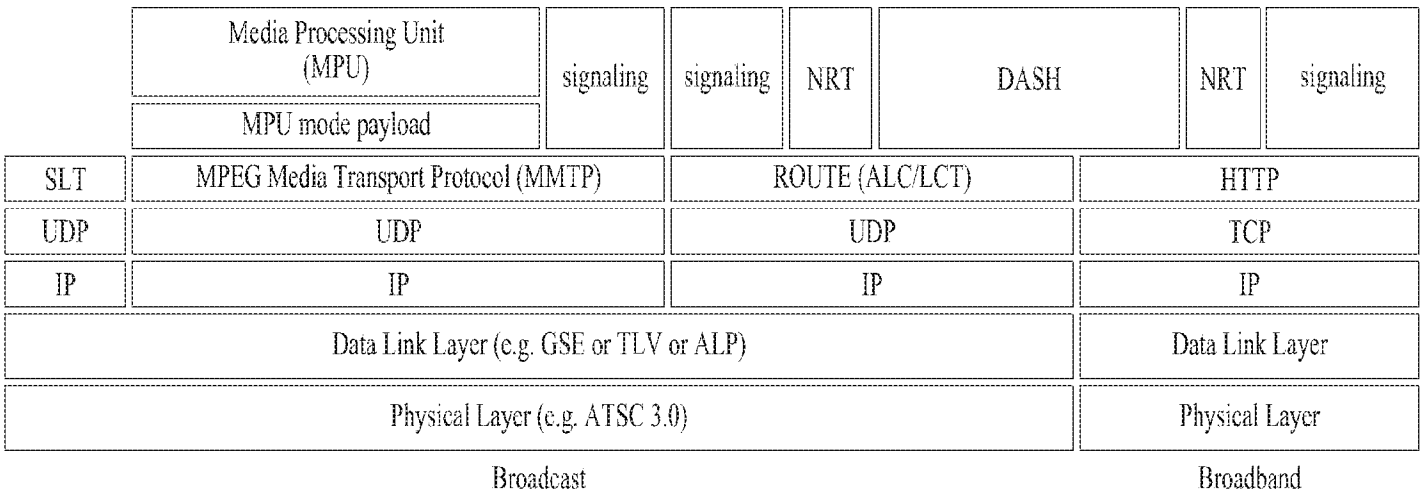
FIG. 1 is a diagram showing a protocol stack according to an embodiment of the present invention.

FIG. 1 is a diagram showing a protocol stack according to an embodiment of the present invention.

A service may be delivered to a receiver through a plurality of layers. First, a transmission side may generate service data. The service data may be processed for transmission at a delivery layer of the transmission side and the service data may be encoded into a broadcast signal and transmitted over a broadcast or broadband network at a physical layer.

Here, the service data may be generated in an ISO base media file format (BMFF). ISO BMFF media files may be used for broadcast/broadband network delivery, media encapsulation and/or synchronization format. Here, the service data is all data related to the service and may include service components configuring a linear service, signaling information thereof, non real time (NRT) data and other files.

The delivery layer will be described. The delivery layer may provide a function for transmitting service data. The service data may be delivered over a broadcast and/or broadband network.

Broadcast service delivery may include two methods.

As a first method, service data may be processed in media processing units (MPUs) based on MPEG media transport (MMT) and transmitted using an MMT protocol (MMTP). In this case, the service data delivered using the MMTP may include service components for a linear service and/or service signaling information thereof.

As a second method, service data may be processed into DASH segments and transmitted using real time object delivery over unidirectional transport (ROUTE), based on MPEG DASH. In this case, the service data delivered through the ROUTE protocol may include service components for a linear service, service signaling information thereof and/or NRT data. That is, the NRT data and non-timed data such as files may be delivered through ROUTE.

Data processed according to MMTP or ROUTE protocol may be processed into IP packets through a UDP/IP layer. In service data delivery over the broadcast network, a service list table (SLT) may also be delivered over the broadcast network through a UDP/IP layer. The SLT may be delivered in a low level signaling (LLS) table. The SLT and LLS table will be described later.

IP packets may be processed into link layer packets in a link layer. The link layer may encapsulate various formats of data delivered from a higher layer into link layer packets and then deliver the packets to a physical layer. The link layer will be described later.

In hybrid service delivery, at least one service element may be delivered through a broadband path. In hybrid service delivery, data delivered over broadband may include service components of a DASH format, service signaling information thereof and/or NRT data. This data may be processed through HTTP/TCP/IP and delivered to a physical layer for broadband transmission through a link layer for broadband transmission.

The physical layer may process the data received from the delivery layer (higher layer and/or link layer) and transmit the data over the broadcast or broadband network. A detailed description of the physical layer will be given later.

The service will be described. The service may be a collection of service components displayed to a user, the components may be of various media types, the service may be continuous or intermittent, the service may be real time or non real time, and a real-time service may include a sequence of TV programs.

The service may have various types. First, the service may be a linear audio/video or audio service having app based enhancement. Second, the service may be an app based service, reproduction/configuration of which is controlled by a downloaded application. Third, the service may be an ESG service for providing an electronic service guide (ESG). Fourth, the service may be an emergency alert (EA) service for providing emergency alert information.

When a linear service without app based enhancement is delivered over the broadcast network, the service component may be delivered by (1) one or more ROUTE sessions or (2) one or more MMTP sessions.

When a linear service having app based enhancement is delivered over the broadcast network, the service component may be delivered by (1) one or more ROUTE sessions or (2) zero or more MMTP sessions. In this case, data used for app based enhancement may be delivered through a ROUTE session in the form of NRT data or other files. In one embodiment of the present invention, simultaneous delivery of linear service components (streaming media components) of one service using two protocols may not be allowed.

When an app based service is delivered over the broadcast network, the service component may be delivered by one or more ROUTE sessions. In this case, the service data used for the app based service may be delivered through the ROUTE session in the form of NRT data or other files.

Some service components of such a service, some NRT data, files, etc. may be delivered through broadband (hybrid service delivery).

That is, in one embodiment of the present invention, linear service components of one service may be delivered through the MMT protocol. In another embodiment of the present invention, the linear service components of one service may be delivered through the ROUTE protocol. In another embodiment of the present invention, the linear service components of one service and NRT data (NRT service components) may be delivered through the ROUTE protocol. In another embodiment of the present invention, the linear service components of one service may be delivered through the MMT protocol and the NRT data (NRT service components) may be delivered through the ROUTE protocol. In the above-described embodiments, some service components of the service or some NRT data may be delivered through broadband. Here, the app based service and data regarding app based enhancement may be delivered over the broadcast network according to ROUTE or through broadband in the form of NRT data. NRT data may be referred to as locally cached data.

Each ROUTE session includes one or more LCT sessions for wholly or partially delivering content components configuring the service. In streaming service delivery, the LCT session may deliver individual components of a user service, such as audio, video or closed caption stream. The streaming media is formatted into a DASH segment.

Each MMTP session includes one or more MMTP packet flows for delivering all or some of content components or an MMT signaling message. The MMTP packet flow may deliver a component formatted into MPU or an MMT signaling message.

For delivery of an NRT user service or system metadata, the LCT session delivers a file based content item. Such content files may include consecutive (timed) or discrete (non-timed) media components of the NRT service or metadata such as service signaling or ESG fragments. System metadata such as service signaling or ESG fragments may be delivered through the signaling message mode of the MMTP.

A receiver may detect a broadcast signal while a tuner tunes to frequencies. The receiver may extract and send an SLT to a processing module. The SLT parser may parse the SLT and acquire and store data in a channel map. The receiver may acquire and deliver bootstrap information of the SLT to a ROUTE or MMT client. The receiver may acquire and store an SLS. USBD may be acquired and parsed by a signaling parser.

Figure 2:
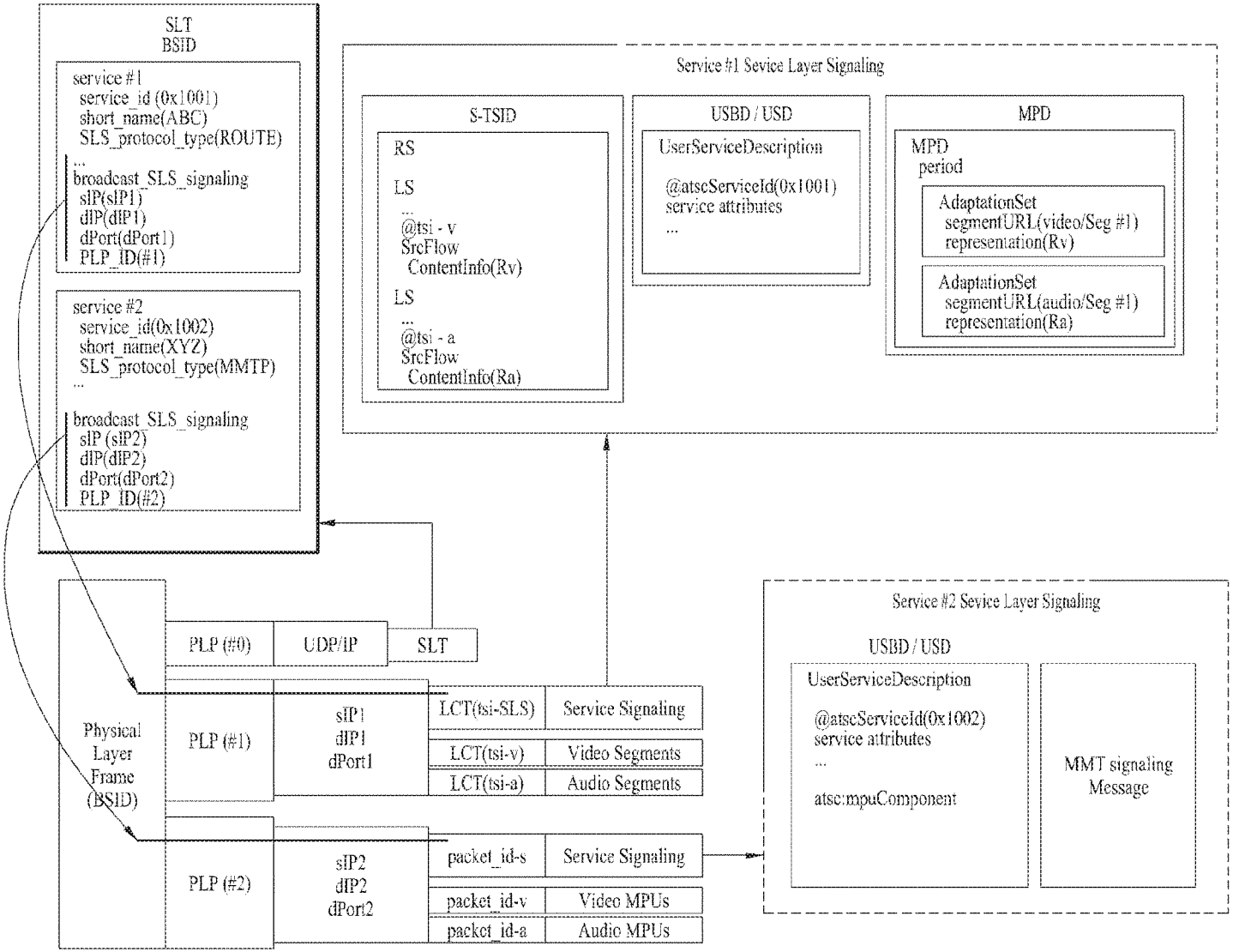
FIG. 2 is a diagram showing a service discovery procedure according to an embodiment of the present invention.

FIG. 2 is a diagram showing a service discovery procedure according to one embodiment of the present invention.

A broadcast stream delivered by a broadcast signal frame of a physical layer may carry low level signaling (LLS). LLS data may be carried through payload of IP packets delivered to a well-known IP address/port. This LLS may include an SLT according to type thereof. The LLS data may be formatted in the form of an LLS table. A first byte of every UDP/IP packet carrying the LLS data may be the start of the LLS table. Unlike the shown embodiment, an IP stream for delivering the LLS data may be delivered to a PLP along with other service data.

The SLT may enable the receiver to generate a service list through fast channel scan and provides access information for locating the SLS. The SLT includes bootstrap information. This bootstrap information may enable the receiver to acquire service layer signaling (SLS) of each service. When the SLS, that is, service signaling information, is delivered through ROUTE, the bootstrap information may include an LCT channel carrying the SLS, a destination IP address of a ROUTE session including the LCT channel and destination port information. When the SLS is delivered through the MMT, the bootstrap information may include a destination IP address of an MMTP session carrying the SLS and destination port information.

In the shown embodiment, the SLS of service #1 described in the SLT is delivered through ROUTE and the SLT may include bootstrap information sIP1, dIP1 and dPort1 of the ROUTE session including the LCT channel delivered by the SLS. The SLS of service #2 described in the SLT is delivered through MMT and the SLT may include bootstrap information sIP2, dIP2 and dPort2 of the MMTP session including the MMTP packet flow delivered by the SLS.

The SLS is signaling information describing the properties of the service and may include receiver capability information for significantly reproducing the service or providing information for acquiring the service and the service component of the service. When each service has separate service signaling, the receiver acquires appropriate SLS for a desired service without parsing all SLSs delivered within a broadcast stream.

When the SLS is delivered through the ROUTE protocol, the SLS may be delivered through a dedicated LCT channel of a ROUTE session indicated by the SLT. In some embodiments, this LCT channel may be an LCT channel identified by tsi=0. In this case, the SLS may include a user service bundle description (USBD)/user service description (USD), service-based transport session instance description (S-TSID) and/or media presentation description (MPD).

Here, USBD/USD is one of SLS fragments and may serve as a signaling hub describing detailed description information of a service. The USBD may include service identification information, device capability information, etc. The USBD may include reference information (URI reference) of other SLS fragments (S-TSID, MPD, etc.). That is, the USBD/USD may reference the S-TSID and the MPD. In addition, the USBD may further include metadata information for enabling the receiver to decide a transmission mode (broadcast/broadband network). A detailed description of the USBD/USD will be given below.

The S-TSID is one of SLS fragments and may provide overall session description information of a transport session carrying the service component of the service. The S-TSID may provide the ROUTE session through which the service component of the service is delivered and/or transport session description information for the LCT channel of the ROUTE session. The S-TSID may provide component acquisition information of service components associated with one service. The S-TSID may provide mapping between DASH representation of the MPD and the tsi of the service component. The component acquisition information of the S-TSID may be provided in the form of the identifier of the associated DASH representation and tsi and may or may not include a PLP ID in some embodiments. Through the component acquisition information, the receiver may collect audio/video components of one service and perform buffering and decoding of DASH media segments. The S-TSID may be referenced by the USBD as described above. A detailed description of the S-TSID will be given below.

The MPD is one of SLS fragments and may provide a description of DASH media presentation of the service. The MPD may provide a resource identifier of media segments and provide context information within the media presentation of the identified resources. The MPD may describe DASH representation (service component) delivered over the broadcast network and describe additional DASH presentation delivered over broadband (hybrid delivery). The MPD may be referenced by the USBD as described above.

When the SLS is delivered through the MMT protocol, the SLS may be delivered through a dedicated MMTP packet flow of the MMTP session indicated by the SLT. In some embodiments, the packet_id of the MMTP packets delivering the SLS may have a value of 00. In this case, the SLS may include a USBD/USD and/or MMT packet (MP) table.

Here, the USBD is one of SLS fragments and may describe detailed description information of a service as in ROUTE. This USBD may include reference information (URI information) of other SLS fragments. The USBD of the MMT may reference an MP table of MMT signaling. In some embodiments, the USBD of the MMT may include reference information of the S-TSID and/or the MPD. Here, the S-TSID is for NRT data delivered through the ROUTE protocol. Even when a linear service component is delivered through the MMT protocol, NRT data may be delivered via the ROUTE protocol. The MPD is for a service component delivered over broadband in hybrid service delivery. The detailed description of the USBD of the MMT will be given below.

The MP table is a signaling message of the MMT for MPU components and may provide overall session description information of an MMTP session carrying the service component of the service. In addition, the MP table may include a description of an asset delivered through the MMTP session. The MP table is streaming signaling information for MPU components and may provide a list of assets corresponding to one service and location information (component acquisition information) of these components. The detailed description of the MP table may be defined in the MMT or modified. Here, the asset is a multimedia data entity, is combined by one unique ID, and may mean a data entity used to one multimedia presentation. The asset may correspond to service components configuring one service. A streaming service component (MPU) corresponding to a desired service may be accessed using the MP table. The MP table may be referenced by the USBD as described above.

The other MMT signaling messages may be defined. Additional information associated with the service and the MMTP session may be described by such MMT signaling messages.

The ROUTE session is identified by a source IP address, a destination IP address and a destination port number. The LCT session is identified by a unique transport session identifier (TSI) within the range of a parent ROUTE session. The MMTP session is identified by a destination IP address and a destination port number. The MMTP packet flow is identified by a unique packet_id within the range of a parent MMTP session.

In case of ROUTE, the S-TSID, the USBD/USD, the MPD or the LCT session delivering the same may be referred to as a service signaling channel. In case of MMTP, the USBD/UD, the MMT signaling message or the packet flow delivering the same may be referred to as a service signaling channel.

Unlike the shown embodiment, one ROUTE or MMTP session may be delivered over a plurality of PLPs. That is, one service may be delivered through one or more PLPs. Unlike the shown embodiment, in some embodiments, components configuring one service may be delivered through different ROUTE sessions. In addition, in some embodiments, components configuring one service may be delivered through different MMTP sessions. In some embodiments, components configuring one service may be divided and delivered in a ROUTE session and an MMTP session. Although not shown, components configuring one service may be delivered through broadband (hybrid delivery).

FIG. 3 is a diagram showing a low level signaling (LLS) table and a service list table (SLT) according to one embodiment of the present invention.

One embodiment t3010 of the LLS table may include information according to an LLS_table_id field, a provider_id field, an LLS_table_version field and/or an LLS_table_id field.

The LLS_table_id field may identify the type of the LLS table, and the provider_id field may identify a service provider associated with services signaled by the LLS table. Here, the service provider is a broadcaster using all or some of the broadcast streams and the provider_id field may identify one of a plurality of broadcasters which is using the broadcast streams. The LLS_table_version field may provide the version information of the LLS table.

According to the value of the LLS_table_id field, the LLS table may include one of the above-described SLT, a rating region table (RRT) including information on a content advisory rating, SystemTime information for providing information associated with a system time, a common alert protocol (CAP) message for providing information associated with emergency alert. In some embodiments, the other information may be included in the LLS table.

One embodiment t3020 of the shown SLT may include an @bsid attribute, an @sltCapabilities attribute, an sltInetUrl element and/or a Service element. Each field may be omitted according to the value of the shown Use column or a plurality of fields may be present.

The @bsid attribute may be the identifier of a broadcast stream. The @sltCapabilities attribute may provide capability information required to decode and significantly reproduce all services described in the SLT. The sltInetUrl element may provide base URL information used to obtain service signaling information and ESG for the services of the SLT over broadband. The sltInetUrl element may further include an @urlType attribute, which may indicate the type of data capable of being obtained through the URL.

The Service element may include information on services described in the SLT, and the Service element of each service may be present. The Service element may include an @serviceId attribute, an @sltSvcSeqNum attribute, an @protected attribute, an @majorChannelNo attribute, an @minorChannelNo attribute, an @serviceCategory attribute, an @shortServiceName attribute, an @hidden attribute, an @broadbandAccessRequired attribute, an @svcCapabilities attribute, a BroadcastSvcSignaling element and/or an svcInetUrl element.

The @serviceId attribute is the identifier of the service and the @sltSvcSeqNum attribute may indicate the sequence number of the SLT information of the service. The @protected attribute may indicate whether at least one service component necessary for significant reproduction of the service is protected. The @majorChannelNo attribute and the @minorChannelNo attribute may indicate the major channel number and minor channel number of the service, respectively.

The @serviceCategory attribute may indicate the category of the service. The category of the service may include a linear A/V service, a linear audio service, an app based service, an ESG service, an EAS service, etc. The @shortServiceName attribute may provide the short name of the service. The @hidden attribute may indicate whether the service is for testing or proprietary use. The @broadbandAccessRequired attribute may indicate whether broadband access is necessary for significant reproduction of the service. The @svcCapabilities attribute may provide capability information necessary for decoding and significant reproduction of the service.

The BroadcastSvcSignaling element may provide information associated with broadcast signaling of the service. This element may provide information such as location, protocol and address with respect to signaling over the broadcast network of the service. Details thereof will be described below.

The svcInetUrl element may provide URL information for accessing the signaling information of the service over broadband. The sltInetUrl element may further include an @urlType attribute, which may indicate the type of data capable of being obtained through the URL.

The above-described BroadcastSvcSignaling element may include an @slsProtocol attribute, an @slsMajorProtocolVersion attribute, an @slsMinorProtocolVersion attribute, an @slsPlpId attribute, an @slsDestinationIpAddress attribute, an @slsDestinationUdpPort attribute and/or an @slsSourceIpAddress attribute.

The @slsProtocol attribute may indicate the protocol used to deliver the SLS of the service (ROUTE, MMT, etc.). The @slsMajorProtocolVersion attribute and the @slsMinorProtocolVersion attribute may indicate the major version number and minor version number of the protocol used to deliver the SLS of the service, respectively.

The @slsPlpId attribute may provide a PLP identifier for identifying the PLP delivering the SLS of the service. In some embodiments, this field may be omitted and the PLP information delivered by the SLS may be checked using a combination of the information of the below-described LMT and the bootstrap information of the SLT.

The @slsDestinationIpAddress attribute, the @slsDestinationUdpPort attribute and the @slsSourceIpAddress attribute may indicate the destination IP address, destination UDP port and source IP address of the transport packets delivering the SLS of the service, respectively. These may identify the transport session (ROUTE session or MMTP session) delivered by the SLS. These may be included in the bootstrap information.

FIG. 4 is a diagram showing a USBD and an S-TSID delivered through ROUTE according to one embodiment of the present invention.

One embodiment t4010 of the shown USBD may have a bundleDescription root element. The bundleDescription root element may have a userServiceDescription element. The userServiceDescription element may be an instance of one service.

The userServiceDescription element may include an @globalServiceID attribute, an @serviceId attribute, an @serviceStatus attribute, an @fullMPDUri attribute, an @sTSIDUri attribute, a name element, a serviceLanguage element, a capabilityCode element and/or a deliveryMethod element. Each field may be omitted according to the value of the shown Use column or a plurality of fields may be present.

The @globalServiceID attribute is the globally unique identifier of the service and may be used for link with ESG data (Service@globalServiceID). The @serviceId attribute is a reference corresponding to the service entry of the SLT and may be equal to the service ID information of the SLT. The @serviceStatus attribute may indicate the status of the service. This field may indicate whether the service is active or inactive.

The @fullMPDUri attribute may reference the MPD fragment of the service. The MPD may provide a reproduction description of a service component delivered over the broadcast or broadband network as described above. The @sTSIDUri attribute may reference the S-TSID fragment of the service. The S-TSID may provide parameters associated with access to the transport session carrying the service as described above.

The name element may provide the name of the service. This element may further include an @lang attribute and this field may indicate the language of the name provided by the name element. The serviceLanguage element may indicate available languages of the service. That is, this element may arrange the languages capable of being provided by the service.

The capabilityCode element may indicate capability or capability group information of a receiver necessary to significantly reproduce the service. This information is compatible with capability information format provided in service announcement.

The deliveryMethod element may provide transmission related information with respect to content accessed over the broadcast or broadband network of the service. The deliveryMethod element may include a broadcastAppService element and/or a unicastAppService element. Each of these elements may have a basePattern element as a sub element.

The broadcastAppService element may include transmission associated information of the DASH representation delivered over the broadcast network. The DASH representation may include media components over all periods of the service presentation.

The basePattern element of this element may indicate a character pattern used for the receiver to perform matching with the segment URL. This may be used for a DASH client to request the segments of the representation. Matching may imply delivery of the media segment over the broadcast network.

The unicastAppService element may include transmission related information of the DASH representation delivered over broadband. The DASH representation may include media components over all periods of the service media presentation.

The basePattern element of this element may indicate a character pattern used for the receiver to perform matching with the segment URL. This may be used for a DASH client to request the segments of the representation. Matching may imply delivery of the media segment over broadband.

One embodiment t4020 of the shown S-TSID may have an S-TSID root element. The S-TSID root element may include an @serviceId attribute and/or an RS element. Each field may be omitted according to the value of the shown Use column or a plurality of fields may be present.

The @serviceId attribute is the identifier of the service and may reference the service of the USBD/USD. The RS element may describe information on ROUTE sessions through which the service components of the service are delivered. According to the number of ROUTE sessions, a plurality of elements may be present. The RS element may further include an @bsid attribute, an @sIpAddr attribute, an @dIpAddr attribute, an @dport attribute, an @PLPID attribute and/or an LS element.

The @bsid attribute may be the identifier of a broadcast stream in which the service components of the service are delivered. If this field is omitted, a default broadcast stream may be a broadcast stream including the PLP delivering the SLS of the service. The value of this field may be equal to that of the @bsid attribute.

The @sIpAddr attribute, the @dIpAddr attribute and the @dport attribute may indicate the source IP address, destination IP address and destination UDP port of the ROUTE session, respectively. When these fields are omitted, the default values may be the source address, destination IP address and destination UDP port values of the current ROUTE session delivering the SLS, that is, the S-TSID. This field may not be omitted in another ROUTE session delivering the service components of the service, not in the current ROUTE session.

The @PLPID attribute may indicate the PLP ID information of the ROUTE session. If this field is omitted, the default value may be the PLP ID value of the current PLP delivered by the S-TSID. In some embodiments, this field is omitted and the PLP ID information of the ROUTE session may be checked using a combination of the information of the below-described LMT and the IP address/UDP port information of the RS element.

The LS element may describe information on LCT channels through which the service components of the service are transmitted. According to the number of LCT channel, a plurality of elements may be present. The LS element may include an @tsi attribute, an @PLPID attribute, an @bw attribute, an @startTime attribute, an @endTime attribute, a SrcFlow element and/or a RepairFlow element.

The @tsi attribute may indicate the tsi information of the LCT channel Using this, the LCT channels through which the service components of the service are delivered may be identified. The @PLPID attribute may indicate the PLP ID information of the LCT channel. In some embodiments, this field may be omitted. The @bw attribute may indicate the maximum bandwidth of the LCT channel. The @startTime attribute may indicate the start time of the LCT session and the @endTime attribute may indicate the end time of the LCT channel.

The SrcFlow element may describe the source flow of ROUTE. The source protocol of ROUTE is used to transmit a delivery object and at least one source flow may be established within one ROUTE session. The source flow may deliver associated objects as an object flow.

The RepairFlow element may describe the repair flow of ROUTE. Delivery objects delivered according to the source protocol may be protected according to forward error correction (FEC) and the repair protocol may define an FEC framework enabling FEC protection.

FIG. 5 is a diagram showing a USBD delivered through MMT according to one embodiment of the present invention.

One embodiment of the shown USBD may have a bundleDescription root element. The bundleDescription root element may have a userServiceDescription element. The userServiceDescription element may be an instance of one service.

The userServiceDescription element may include an @globalServiceID attribute, an @serviceId attribute, a Name element, a serviceLanguage element, a contentAdvisoryRating element, a Channel element, a mpuComponent element, a routeComponent element, a broadbandComponent element and/or a ComponentInfo element. Each field may be omitted according to the value of the shown Use column or a plurality of fields may be present.

The @globalServiceID attribute, the @serviceId attribute, the Name element and/or the serviceLanguage element may be equal to the fields of the USBD delivered through ROUTE. The contentAdvisoryRating element may indicate the content advisory rating of the service. This information is compatible with content advisory rating information format provided in service announcement. The Channel element may include information associated with the service. A detailed description of this element will be given below.

The mpuComponent element may provide a description of service components delivered as the MPU of the service. This element may further include an @mmtPackageId attribute and/or an @nextMmtPackageId attribute. The @mmtPackageId attribute may reference the MMT package of the service components delivered as the MPU of the service. The @nextMmtPackageId attribute may reference an MMT package to be used after the MMT package referenced by the @mmtPackageId attribute in terms of time. Through the information of this element, the MP table may be referenced.

The routeComponent element may include a description of the service components of the service. Even when linear service components are delivered through the MMT protocol, NRT data may be delivered according to the ROUTE protocol as described above. This element may describe information on such NRT data. A detailed description of this element will be given below.

The broadbandComponent element may include the description of the service components of the service delivered over broadband. In hybrid service delivery, some service components of one service or other files may be delivered over broadband. This element may describe information on such data. This element may further an @fullMPDUri attribute. This attribute may reference the MPD describing the service component delivered over broadband. In addition to hybrid service delivery, the broadcast signal may be weakened due to traveling in a tunnel and thus this element may be necessary to support handoff between broadband and broadband. When the broadcast signal is weak, the service component is acquired over broadband and, when the broadcast signal becomes strong, the service component is acquired over the broadcast network to secure service continuity.

The ComponentInfo element may include information on the service components of the service. According to the number of service components of the service, a plurality of elements may be present. This element may describe the type, role, name, identifier or protection of each service component. Detailed information of this element will be described below.

The above-described Channel element may further include an @serviceGenre attribute, an @serviceIcon attribute and/or a ServiceDescription element. The @serviceGenre attribute may indicate the genre of the service and the @serviceIcon attribute may include the URL information of the representative icon of the service. The ServiceDescription element may provide the service description of the service and this element may further include an @serviceDescrText attribute and/or an @serviceDescrLang attribute. These attributes may indicate the text of the service description and the language used in the text.

The above-described routeComponent element may further include an @sTSIDUri attribute, an @sTSIDDestinationIpAddress attribute, an @sTSIDDestinationUdpPort attribute, an @sTSIDSourceIpAddress attribute, an @sTSIDMajorProtocolVersion attribute and/or an @sTSIDMinorProtocolVersion attribute.

The @sTSIDUri attribute may reference an S-TSID fragment. This field may be equal to the field of the USBD delivered through ROUTE. This S-TSID may provide access related information of the service components delivered through ROUTE. This S-TSID may be present for NRT data delivered according to the ROUTE protocol in a state of delivering linear service component according to the MMT protocol.

The @sTSIDDestinationIpAddress attribute, the @sTSIDDestinationUdpPort attribute and the @sTSIDSourceIpAddress attribute may indicate the destination IP address, destination UDP port and source IP address of the transport packets carrying the above-described S-TSID. That is, these fields may identify the transport session (MMTP session or the ROUTE session) carrying the above-described S-TSID.

The @sTSIDMajorProtocolVersion attribute and the @sTSIDMinorProtocolVersion attribute may indicate the major version number and minor version number of the transport protocol used to deliver the above-described S-TSID, respectively.

The above-described ComponentInfo element may further include an @componentType attribute, an @componentRole attribute, an @componentProtectedFlag attribute, an @componentId attribute and/or an @componentName attribute.

The @componentType attribute may indicate the type of the component. For example, this attribute may indicate whether the component is an audio, video or closed caption component. The @componentRole attribute may indicate the role of the component. For example, this attribute may indicate main audio, music, commentary, etc. if the component is an audio component. This attribute may indicate primary video if the component is a video component. This attribute may indicate a normal caption or an easy reader type if the component is a closed caption component.

The @componentProtectedFlag attribute may indicate whether the service component is protected, for example, encrypted. The @componentId attribute may indicate the identifier of the service component. The value of this attribute may be the asset_id (asset ID) of the MP table corresponding to this service component. The @componentName attribute may indicate the name of the service component.

FIG. 6 is a diagram showing link layer operation according to one embodiment of the present invention.

The link layer may be a layer between a physical layer and a network layer. A transmission side may transmit data from the network layer to the physical layer and a reception side may transmit data from the physical layer to the network layer (t6010). The purpose of the link layer is to compress (abstract) all input packet types into one format for processing by the physical layer and to secure flexibility and expandability of an input packet type which is not defined yet. In addition, the link layer may provide option for compressing (abstracting) unnecessary information of the header of input packets to efficiently transmit input data. Operation such as overhead reduction, encapsulation, etc. of the link layer is referred to as a link layer protocol and packets generated using this protocol may be referred to as link layer packets. The link layer may perform functions such as packet encapsulation, overhead reduction and/or signaling transmission.

At the transmission side, the link layer (ALP) may perform an overhead reduction procedure with respect to input packets and then encapsulate the input packets into link layer packets. In addition, in some embodiments, the link layer may perform encapsulation into the link layer packets without performing the overhead reduction procedure. Due to use of the link layer protocol, data transmission overhead on the physical layer may be significantly reduced and the link layer protocol according to the present invention may provide IP overhead reduction and/or MPEG-2 TS overhead reduction.

When the shown IP packets are input as input packets (t6010), the link layer may sequentially perform IP header compression, adaptation and/or encapsulation. In some embodiments, some processes may be omitted. For example, the RoHC module may perform IP packet header compression to reduce unnecessary overhead. Context information may be extracted through the adaptation procedure and transmitted out of band. The IP header compression and adaption procedure may be collectively referred to as IP header compression. Thereafter, the IP packets may be encapsulated into link layer packets through the encapsulation procedure.

When MPEG 2 TS packets are input as input packets, the link layer may sequentially perform overhead reduction and/or an encapsulation procedure with respect to the TS packets. In some embodiments, some procedures may be omitted. In overhead reduction, the link layer may provide sync byte removal, null packet deletion and/or common header removal (compression). Through sync byte removal, overhead reduction of 1 byte may be provided per TS packet. Null packet deletion may be performed in a manner in which reinsertion is possible at the reception side. In addition, deletion (compression) may be performed in a manner in which common information between consecutive headers may be restored at the reception side. Some of the overhead reduction procedures may be omitted. Thereafter, through the encapsulation procedure, the TS packets may be encapsulated into link layer packets. The link layer packet structure for encapsulation of the TS packets may be different from that of the other types of packets.

First, IP header compression will be described.

The IP packets may have a fixed header format but some information necessary for a communication environment may be unnecessary for a broadcast environment. The link layer protocol may compress the header of the IP packet to provide a mechanism for reducing broadcast overhead.

IP header compression may include a header compressor/decompressor and/or an adaptation module. The IP header compressor (RoHC compressor) may reduce the size of each IP packet based on a RoHC method. Then, adaptation module may extract context information and generate signaling information from each packet stream. A receiver may parse signaling information related to a corresponding packet stream and attach the context information to the packet stream. The RoHC decompressor may recover a packet header to reconfigure an original IP packet. Hereinafter, IP header compression may refer to only IP header compressor via header compressor and may be a concept that combines IP header compression and the adaptation procedure by the adaptation module. This may be the same as in decompressing.

Hereinafter, adaptation will be described.

In transmission of a single-direction link, when the receiver does not have context information, the decompressor cannot restore the received packet header until complete context is received. This may lead to channel change delay and turn-on delay. Accordingly, through the adaptation function, configuration parameters and context information between the compressor and the decompressor may be transmitted out of band. The adaptation function may construct link layer signaling using context information and/or configuration parameters. The adaptation function may periodically transmit link layer signaling through each physical frame using a previous configuration parameter and/or context information.

Context information is extracted from the compressed IP packets and various methods may be used according to adaptation mode.

Mode #1 refers to a mode in which no operation is performed with respect to the compressed packet stream and an adaptation module operates as a buffer.

Mode #2 refers to a mode in which an IR packet is detected from a compressed packet stream to extract context information (static chain). After extraction, the IR packet is converted into an IR-DYN packet and the IR-DYN packet may be transmitted in the same order within the packet stream in place of an original IR packet.

Mode #3 (t6020) refers to a mode in which IR and IR-DYN packets are detected from a compressed packet stream to extract context information. A static chain and a dynamic chain may be extracted from the IR packet and a dynamic chain may be extracted from the IR-DYN packet. After extraction, the IR and IR-DYN packets are converted into normal compression packets. The converted packets may be transmitted in the same order within the packet stream in place of original IR and IR-DYN packets.

In each mode, the context information is extracted and the remaining packets may be encapsulated and transmitted according to the link layer packet structure for the compressed IP packets. The context information may be encapsulated and transmitted according to the link layer packet structure for signaling information, as link layer signaling.

The extracted context information may be included in a RoHC-U description table (RDT) and may be transmitted separately from the RoHC packet flow. Context information may be transmitted through a specific physical data path along with other signaling information. The specific physical data path may mean one of normal PLPs, a PLP in which low level signaling (LLS) is delivered, a dedicated PLP or an L1 signaling path. Here, the RDT may be context information (static chain and/or dynamic chain) and/or signaling information including information associated with header compression. In some embodiments, the RDT may be transmitted whenever context information is changed. In some embodiments, the RDT may be transmitted in every physical frame. To transmit the RDT in every physical frame, a previous RDT may be re-used.

The receiver may select a first PLP and first acquire signaling information of the SLT, the RDT, etc., prior to acquisition of a packet stream. Upon acquiring the signaling information, the receiver may combine the information to acquire mapping of service—IP information—context information—PLP. That is, the receiver may recognize IP streams through which a service is transmitted, IP streams transmitted through a PLP, and so on and acquire corresponding context information of the PLPs. The receiver may select a PLP for delivery of a specific packet stream and decode the PLP. The adaptation module may parse the context information and combine the context information with the compressed packets. Thereby, the packet stream may be recovered and transmitted to the RoHC de compressor. Then, decompression may be started. In this case, the receiver may detect an IR packet and start decompression from a first received IR packet according to an adaptation mode (mode 1), may detect an IR-DYN packet and start decompression from a first received IR-DYN packet (mode 2), or may start decompression from any general compressed packet (mode 3).

Hereinafter, packet encapsulation will be described.

The link layer protocol may encapsulate all types of input packets such as IP packets, TS packets, etc. into link layer packets. To this end, the physical layer processes only one packet format independently of the protocol type of the network layer (here, an MPEG-2 TS packet is considered as a network layer packet). Each network layer packet or input packet is modified into the payload of a generic link layer packet.

In the packet encapsulation procedure, segmentation may be used. If the network layer packet is too large to be processed in the physical layer, the network layer packet may be segmented into two or more segments. The link layer packet header may include fields for segmentation of the transmission side and recombination of the reception side. Each segment may be encapsulated into the link layer packet in the same order as the original location.

In the packet encapsulation procedure, concatenation may also be used. If the network layer packet is sufficiently small such that the payload of the link layer packet includes several network layer packets, concatenation may be performed. The link layer packet header may include fields for performing concatenation. In concatenation, the input packets may be encapsulated into the payload of the link layer packet in the same order as the original input order.

The link layer packet may include a header and a payload. The header may include a base header, an additional header and/or an optional header. The additional header may be further added according to situation such as concatenation or segmentation and the additional header may include fields suitable for situations. In addition, for delivery of the additional information, the optional header may be further included. Each header structure may be pre-defined. As described above, if the input packets are TS packets, a link layer header having packets different from the other packets may be used.

Hereinafter, link layer signaling will be described.

Link layer signaling may operate at a level lower than that of the IP layer. The reception side may acquire link layer signaling faster than IP level signaling of the LLS, the SLT, the SLS, etc. Accordingly, link layer signaling may be acquired before session establishment.

Link layer signaling may include internal link layer signaling and external link layer signaling. Internal link layer signaling may be signaling information generated at the link layer. This includes the above-described RDT or the below-described LMT. External link layer signaling may be signaling information received from an external module, an external protocol or a higher layer. The link layer may encapsulate link layer signaling into a link layer packet and deliver the link layer packet. A link layer packet structure (header structure) for link layer signaling may be defined and link layer signaling information may be encapsulated according to this structure.

FIG. 7 is a diagram showing a link mapping table (LMT) according to one embodiment of the present invention.

The LMT may provide a list of higher layer sessions carried through the PLP. In addition, the LMT may provide additional information for processing link layer packets carrying the higher layer sessions. Here, the higher layer session may be referred to as multicast. Information on IP streams or transport sessions transmitted through one PLP may be acquired through the LMT. In contrast, information on through which PLP a specific transport session is delivered may be acquired.

The LMT may be transmitted through any PLP identified to deliver the LLS. Here, the PLP for delivering the LLS may be identified by an LLS flag of L1 detail signaling information of a physical layer. The LLS flag may be a flag field indicating whether the LLS is transmitted through a corresponding PLP with respect to each PLP. Here, the L1 detail signaling information may be correspond to PLS2 data which will be described later.

That is, the LMT may also be transmitted through the same PLP along with the LLS. Each LMT may describe mapping between PLPs and IP address/port as described above. As described above, the LLS may include an SLT and, in this regard, the IP address/ports described by the LMT may be any IP address/ports related to any service, described by the SLT transmitted through the PLP such as a corresponding LMT.

In some embodiments, the PLP identifier information in the above-described SLT, SLS, etc. may be used to confirm information indicating through which PLP a specific transport session indicated by the SLT or SLS is transmitted may be confirmed.

In another embodiment, the PLP identifier information in the above-described SLT, SLS, etc. will be omitted and PLP information of the specific transport session indicated by the SLT or SLS may be confirmed by referring to the information in the LMT. In this case, the receiver may combine the LMT and other IP level signaling information to identify the PLP. Even in this embodiment, the PLP information in the SLT, SLS, etc. is not omitted and may remain in the SLT, SLS, etc.

The LMT according to the shown embodiment may include a signaling_type field, a PLP_ID field, a num_session field and/or information on each session. Although the LMT of the shown embodiment describes IP streams transmitted through one PLP, a PLP loop may be added to the LMT to describe information on a plurality of PLPs in some embodiments. In this case, as described above, the LMT may describe PLPs of all IP addresses/ports related to all service described by the SLT transmitted together using a PLP loop.

The signaling_type field may indicate the type of signaling information delivered by the table. The value of signaling_type field for the LMT may be set to 0x01. The signaling_type field may signaling_type field may be omitted. The PLP_ID field may identify a target PLP to be described. When the PLP loop is used, each PLP_ID field may identify each target PLP. Fields from the PLP_ID field may be included in the PLP loop. Here, the below-described PLP_ID field may be an identifier of one PLP of the PLP loop and the following fields may be fields corresponding to the corresponding PLP.

The num_session field may indicate the number of higher layer sessions delivered through the PLP identified by the PLP_ID field. According to the number indicated by the num_session field, information on each session may be included. This information may include a src_IP_add field, a dst_IP_add field, a src_UDP_port field, a dst_UDP_port field, an SID_flag field, a compressed_flag field, an SID field, and/or a context_id field.

The src_IP_add field, the dst_IP_add field, the src_UDP_port field, and the dst_UDP_port field may indicate the source IP address, the destination IP address, the source UDP port and the destination UDP port of the transport session among the higher layer sessions delivered through the PLP identified by the PLP_ID field.

The SID_flag field may indicate whether the link layer packet delivering the transport session has an SID field in the optional header. The link layer packet delivering the higher layer session may have an SID field in the optional header and the SID field value may be equal to that of the SID field in the LMT.

The compressed_flag field may indicate whether header compression is applied to the data of the link layer packet delivering the transport session. In addition, presence/absence of the below-described context_id field may be determined according to the value of this field. When header compression is applied (compressed_flag=1), the RDT may be present and the PLP ID field of the RDT may have the same value as the corresponding PLP_ID field related to the present compressed_flag field.

The SID field may indicate a sub stream ID (SID) of link layer packets for delivering a corresponding transfer session. The link layer packets may include the SID having the same value as the present SID field in the optional header. Thereby, the receiver may filter link layer packets using information of the LMT and SID information of a link layer packet header without parsing of all link layer packets.

The context_id field may provide a reference for a context id (CID) in the RDT. The CID information of the RDT may indicate the context ID of the compression IP packet stream. The RDT may provide context information of the compression IP packet stream. Through this field, the RDT and the LMT may be associated.

In the above-described embodiments of the signaling information/table of the present invention, the fields, elements or attributes may be omitted or may be replaced with other fields. In some embodiments, additional fields, elements or attributes may be added.

In one embodiment of the present invention, service components of one service may be delivered through a plurality of ROUTE sessions. In this case, an SLS may be acquired through bootstrap information of an SLT. An S-TSID and an MPD may be referenced through the USBD of the SLS. The S-TSID may describe not only the ROUTE session delivered by the SLS but also transport session description information of another ROUTE session carried by the service components. To this end, the service components delivered through the plurality of ROUTE sessions may all be collected. This is similarly applicable to the case in which the service components of one service are delivered through a plurality of MMTP sessions. For reference, one service component may be simultaneously used by the plurality of services.

In another embodiment of the present invention, bootstrapping of an ESG service may be performed by a broadcast or broadband network. By acquiring the ESG over broadband, URL information of the SLT may be used. ESG information may be requested using this URL.

In another embodiment of the present invention, one service component of one service may be delivered over the broadcast network and the other service component may be delivered over broadband (hybrid). The S-TSID may describe components delivered over the broadcast network such that the ROUTE client acquires desired service components. In addition, the USBD may have base pattern information to describe which segments (which components) are delivered through which path. Accordingly, the receiver can confirm a segment to be requested from the broadband service and a segment to be detected in a broadcast stream.

In another embodiment of the present invention, scalable coding of a service may be performed. The USBD may have all capability information necessary to render the service. For example, when one service is provided in HD or UHD, the capability information of the USBD may have a value of "HD or UHD". The receiver may check which component is reproduced in order to render the UHD or HD service using the MPD.

In another embodiment of the present invention, through a TOI field of the LCT packets delivered through the LCT channel delivering the SLS, which SLS fragment is delivered using the LCT packets (USBD, S-TSID, MPD, etc.) may be identified.

In another embodiment of the present invention, app components to be used for app based enhancement/an app based service may be delivered over the broadcast network as NRT components or may be delivered over broadband. In addition, app signaling for app based enhancement may be performed by an application signaling table (AST) delivered along with the SLS. In addition, an event which is signaling for operation to be performed by the app may be delivered in the form of an event message table (EMT) along with the SLS, may be signaled in the MPD or may be in-band signaled in the form of a box within DASH representation. The AST, the EMT, etc. may be delivered over broadband. App based enhancement, etc. may be provided using the collected app components and such signaling information.

In another embodiment of the present invention, a CAP message may be included and provided in the above-described LLS table for emergency alert. Rich media content for emergency alert may also be provided. Rich media may be signaled by a CAP message and, if rich media is present, the rich media may be provided as an EAS service signaled by the SLT.

In another embodiment of the present invention, linear service components may be delivered over the broadcast network according to the MMT protocol. In this case, NRT data (e.g., app components) of the service may be delivered over the broadcast network according to the ROUTE protocol. In addition, the data of the service may be delivered over broadband. The receiver may access the MMTP session delivering the SLS using the bootstrap information of the SLT. The USBD of the SLS according to the MMT may reference the MP table such that the receiver acquires linear service components formatted into the MPU delivered according to the MMT protocol. In addition, the USBD may further reference the S-TSID such that the receiver acquires NRT data delivered according to the ROUTE protocol. In addition, the USBD may further reference the MPD to provide a reproduction description of data delivered over broadband.

In another embodiment of the present invention, the receiver may deliver location URL information capable of acquiring a file content item (file, etc.) and/or a streaming component to a companion device through a web socket method. The application of the companion device may acquire components, data, etc. through a request through HTTP GET using this URL. In addition, the receiver may deliver information such as system time information, emergency alert information, etc. to the companion device.

Figure 8:
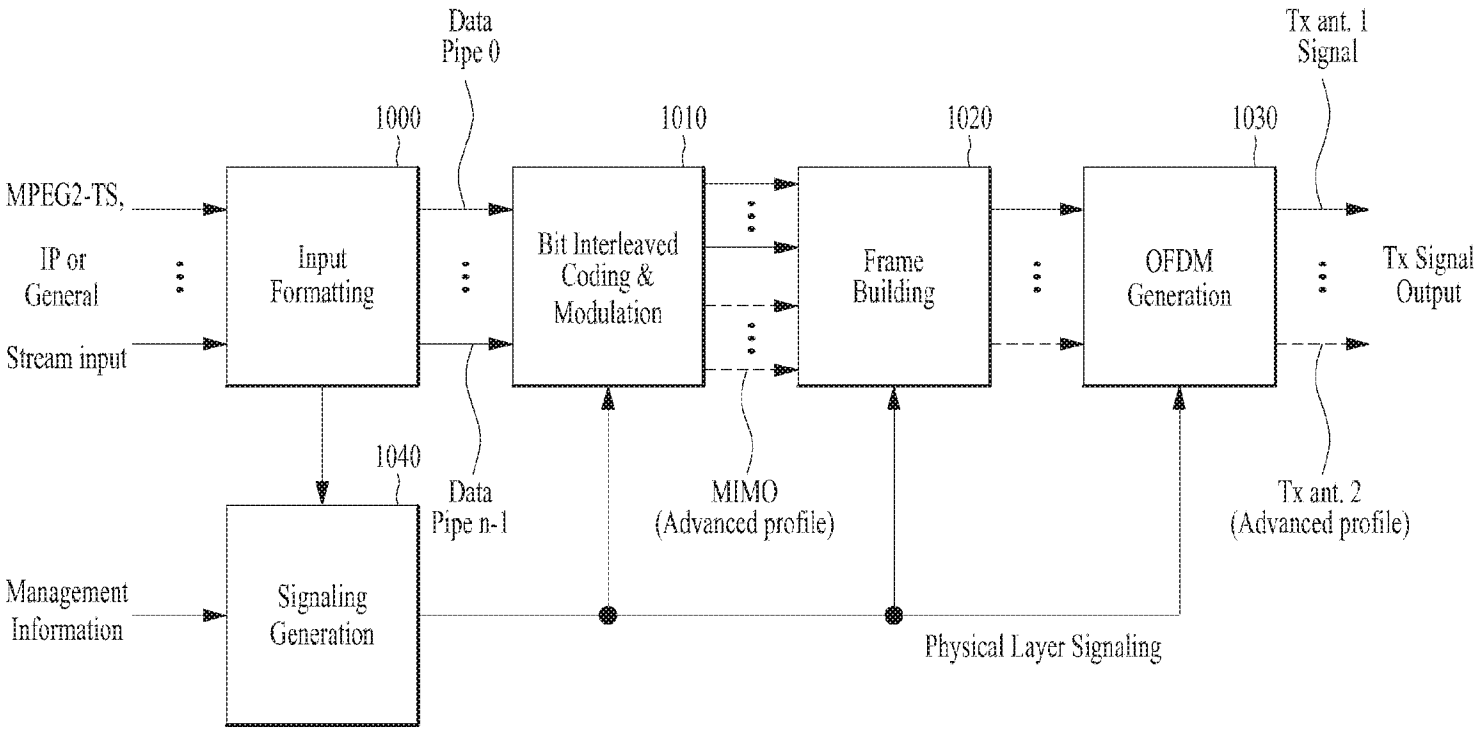
FIG. 8 is a diagram showing a structure of a broadcast signal transmission device of a next-generation broadcast service according to an embodiment of the present invention.

FIG. 8 is a diagram showing a structure of a broadcast signal transmission device of a next-generation broadcast service according to an embodiment of the present invention.

The broadcast signal transmission device of the next-generation broadcast service according to an embodiment of the present invention may include an input format block 1000, a bit interleaved coding & modulation (BICM) block 1010, a frame building block 1020, an orthogonal frequency division multiplexing (OFDM) generation block 1030, and a signaling generation block 1040. An operation of each block of the broadcast signal transmission device will be described.

According to an embodiment of the present invention, input data may use IP stream/packet and MPEG2-TS as main input format and other stream types may be handled as a general stream.

The input format block 1000 may demultiplex each input stream using one or more data pipes to which independent coding and modulation are applied. The data pipe may be a basic unit for robustness control and may affect quality of service (QoS). One or more services or service components may affect one data pipe. The data pipe may be a logical channel in a physical layer for delivering service data or metadata for delivering one or more services or service components.

Since QoS is dependent upon the characteristics of a service provided by the broadcast signal transmission device of the next-generation broadcast service according to an embodiment of the present invention, data corresponding to each service needs to be processed via different methods.

The BICM block 1010 may include a processing block applied to a profile (or system) to which MIMO is not applied and/or a processing block of a profile (or system) to which MIMO is applied and may include a plurality of processing blocks for processing each data pipe.

The processing block of the BICM block to which MIMO is not applied may include a data FEC encoder, a bit interleaver, a constellation mapper, a signal space diversity (SSD) encoding block, and a time interleaver. The processing block of the BICM block to which MIMO is applied is different from the processing block of the BICM to which MIMO is not applied in that a cell word demultiplexer and an MIMO encoding block are further included.

The data FEC encoder may perform FEC encoding on an input BBF to generate a FECBLOCK procedure using external coding (BCH) and internal coding (LDPC). The external coding (BCH) may be a selective coding method. The bit interleaver may interleave output of the data FEC encoder to achieve optimized performance using a combination of the LDPC code and a modulation method. The constellation mapper may modulate cell word from a bit interleaver or a cell word demultiplexer using QPSK, QAM-16, irregular QAM (NUQ-64, NUQ-256, NUQ-1024), or irregular constellation (NUC-16, NUC-64, NUC-256, NUC-1024) and provide a power-normalized constellation point. NUQ has an arbitrary type but QAM-16 and NUQ have a square shape. All of the NUQ and the NUC may be particularly defined with respect to each code rate and signaled by parameter DP_MOD of PLS2 data. The time interleaver may be operated at a data pipe level. A parameter of the time interleaving may be differently set with respect to each data pipe.

The time interleaver according to the present invention may be positioned between the BICM chain and the frame builder. In this case, the time interlever according to the present invention may selectively use a convolution interleaver (CI) and a block interleaver (BI) according to a physical layer pipe (PLP) mode or may use all. The PLP according to an embodiment of the present invention may be a physical path used using the same concept as the aforementioned DP and its term may be changed according to designer intention. The PLP mode according to an embodiment of the present invention may include a single PLP mode or a multiple PLP mode according to the number of PLPs processed by the broadcast signal transmitter or the broadcast signal transmission device. Time interleaving using different time interleaving methods according to a PLP mode may be referred to as hybrid time interleaving.

A hybrid time interleaver may include a block interleaver (BI) and a convolution interleaver (CI). In the case of PLP_NUM=1, the BI may not be applied (BI off) and only the CI may be applied. In the case of PLP_NUM>1, both the BI and the CI may be applied (BI on). The structure and operation of the CI applied in the case of PLP_NUM>1 may be different from those of the CI applied in the case of PLP_NUM=1. The hybrid time interleaver may perform an operation corresponding to a reverse operation of the aforementioned hybrid time interleaver.

The cell word demultiplexer may be used to divide a single cell word stream into a dual cell word stream for MIMO processing. The MIMO encoding block may process output of the cell word demultiplexer using a MIMO encoding method. The MIMO encoding method according to the present invention may be defined as full-rate spatial multiplexing (FR-SM) for providing increase in capacity via relatively low increase in complexity at a receiver side. MIMO processing may be applied at a data pipe level. When a pair of constellation mapper outputs, NUQ $e_{1,i}$ and $e_{2,i}$ is input to a MIMO encoder, a pair of MIMO encoder outputs, g1,i and g2,i may be transmitted by the same carrier k and OFDM symbol 1 of each transmission antenna.

The frame building block 1020 may map a data cell of an input data pipe in one frame to an OFDM symbol and perform frequency interleaving for frequency domain diversity.

According to an embodiment of the present invention, a frame may be divided into a preamble, one or more frame signaling symbols (FSS), and a normal data symbol. The preamble may be a special symbol for providing a combination of basic transmission parameters for effective transmission and reception of a signal. The preamble may signal a basic transmission parameter and a transmission type of a frame. In particular, the preamble may indicate whether an emergency alert service (EAS) is currently provided in a current frame. The objective of the FSS may be to transmit PLS data. For rapid synchronization and channel estimation and rapid decoding of PLS data, the FSS may have a pipe pattern with higher density than a normal data symbol.

The frame building block may include a delay compensation block for adjusting timing between a data pipe and corresponding PLS data to ensure co-time between a data pipe and corresponding PLS data at a transmitting side, a cell mapper for mapping a PLS, a data pipe, an auxiliary stream, a dummy stream, and so on to an active carrier of an OFDM symbol in a frame, and a frequency interleaver.

The frequency interleaver may randomly interleave a data cell received from the cell mapper to provide frequency diversity. The frequency interleaver may operate with respect to data corresponding to an OFDM symbol pair including two sequential OFDM symbols or data corresponding to one OFDM symbol using different interleaving seed orders in order to acquire maximum interleaving gain in a single frame.

The OFDM generation block 1030 may modulate an OFDM carrier by the cell generated by the frame building block, insert a pilot, and generate a time domain signal for transmission. The corresponding block may sequentially insert guard intervals and may apply PAPR reduction processing to generate a last RF signal.

The signaling generation block 1040 may generate physical layer signaling information used in an operation of each functional block. The signaling information according to an embodiment of the present invention may include PLS data. The PLS may provide an element for connecting a receiver to a physical layer data pipe. The PLS data may include PLS1 data and PLS2 data.

The PLS1 data may be a first combination of PLS data transmitted to FSS in a frame with fixed size, coding, and modulation for transmitting basic information on a system as well as a parameter required to data PLS2 data. The PLS1 data may provide a basic transmission parameter including a parameter required to receive and decode PLS2 data. The PLS2 data may be a second combination of PLP data transmitted to FSS for transmitting more detailed PLS data of a data pipe and a system. PLS2 signaling may further include two types of parameters of PLS2 static data (PLS2-STAT data) and PLS2 dynamic data (PLS2-DYN data). The PLS2 static data may be PLS2 data that is static during duration of a frame group and the PLS2 dynamic data may be PLS2 data that is dynamically changed every frame.

The PLS2 data may include FIC_FLAG information. A fast information channel (FIC) may be a dedicated channel for transmitting cross-layer information for enabling fast service acquisition and channel scanning. The FIC_FLAG information may indicate whether a fast information channel (FIC) is used in a current frame group via a 1-bit field. When a value of the corresponding field is set to 1, the FIC may be provided in the current frame. When a value of the corresponding field is set to 0, the FIC may not be transmitted in the current frame. The BICM block 1010 may include a BICM block for protecting PLS data. The BICM block for protecting the PLS data may include a PLS FEC encoder, a bit interleaver, and a constellation mapper.

The PLS FEC encoder may include a scrambler for scrambling PLS1 data and PLS2 data, a BCH encoding/zero inserting block for performing external encoding on the scrambled PLS 1 and 2 data using a BCH code shortened for PLS protection and inserting a zero bit after BCH encoding, a LDPC encoding block for performing encoding using an LDPC code, and an LDPC parity puncturing block. Only the PLS1 data may be permutated before an output bit of zero insertion is LDPC-encoded. The bit interleaver may interleave each of the shortened and punctured PLS1 data and PLS2 data, and the constellation mapper may map the bit-interleaved PLS1 data and PLS2 data to constellation.

A broadcast signal reception device of a next-generation broadcast service according to an embodiment of the present invention may perform a reverse operation of the broadcast signal transmission device of the next-generation broadcast service that has been described with reference to FIG. 8.

The broadcast signal reception device of a next-generation broadcast service according to an embodiment of the present invention may include a synchronization & demodulation module for performing demodulation corresponding to a reverse operation performed by the broadcast signal transmission device, a frame parsing module for parsing an input signal frame to extract data transmitted by a service selected by a user, a demapping & decoding module for converting an input signal into bit region data, deinterleaving bit region data as necessary, performing demapping on mapping applied for transmission efficiency, and correcting error that occurs in a transmission channel for decoding, an output processor for performing a reverse operation of various compression/signal processing procedures applied by the broadcast signal transmission device, and a signaling decoding module for acquiring and processing PLS information from the signal demodulated by the synchronization & demodulation module. The frame parsing module, the demapping & decoding module, and the output processor may perform the functions using the PLS data output from the signaling decoding module.

Hereinafter, the timer interleaver will be described. A time interleaving group according to an embodiment of the present invention may be directly mapped to one frame or may be spread over $P_I$ frames. In addition, each time interleaving group may be divided into one or more ($N_{TI}$) time interleaving blocks. Here, each time interleaving block may correspond to one use of a time interleaver memory. A time interleaving block in the time interleaving group may include different numbers of XFECBLOCK. In general, the time interleaver may also function as a buffer with respect to data pipe data prior to a frame generation procedure.

The time interleaver according to an embodiment of the present invention may be a twisted row-column block interleaver. The twisted row-column block interleaver according to an embodiment of the present invention may write a first XFECBLOCK in a first column of the time interleaving memory, write a second XFECBLOCK in a next column, and write the remaining XFECBLOCKs in the time interleaving block in the same manner. In an interleaving array, a cell may be read in a diagonal direction to a last row from a first row (a leftmost column as a start column is read along a row in a right direction). In this case, to achieve single memory deinterleaving at a receiver side irrespective of the number of XFECBLOCK in the time interleaving block, the interleaving array for the twisted row-column block interleaver may insert a virtual XFECBLOCK into the time interleaving memory. In this case, to achieve single memory deinterleaving at a receiver side, the virtual XFECBLOCK needs to be inserted into another frontmost XFECBLOCK.

Figure 9:
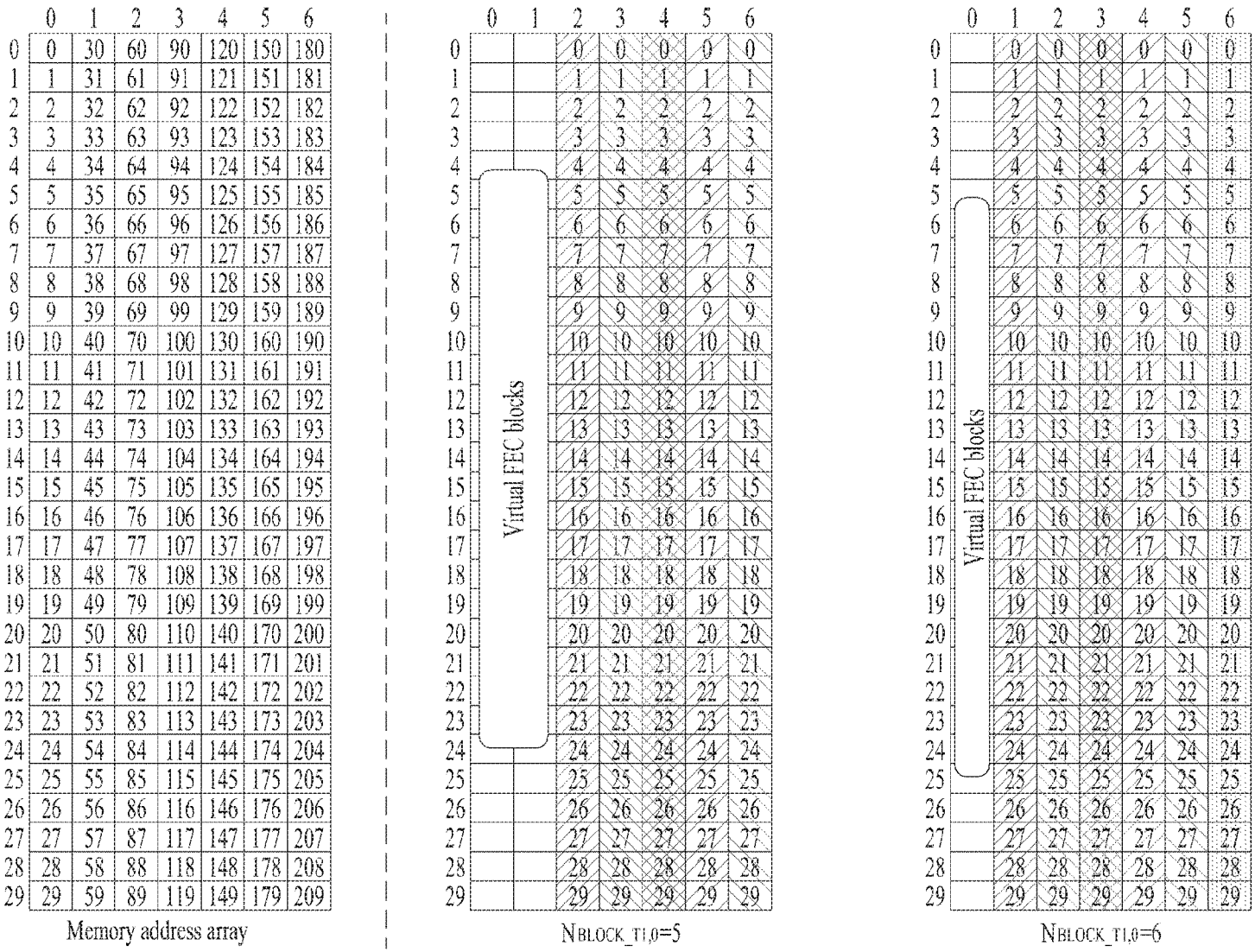
FIG. 9 is a writing operation of a time interleaver according to an embodiment of the present invention.

FIG. 9 is a writing operation of a time interleaver according to an embodiment of the present invention.

A block shown in a left portion of the drawing shows a TI memory address array and a block shown in a right portion of the drawing shows a writing operation when two or one virtual FEC blocks are inserted into a frontmost group of TI groups with respect to two consecutive TI groups.

The frequency interleaver according to an embodiment of the present invention may include an interleaving address generator for generating an interleaving address to be applied to data corresponding to a symbol pair.

Figure 10:
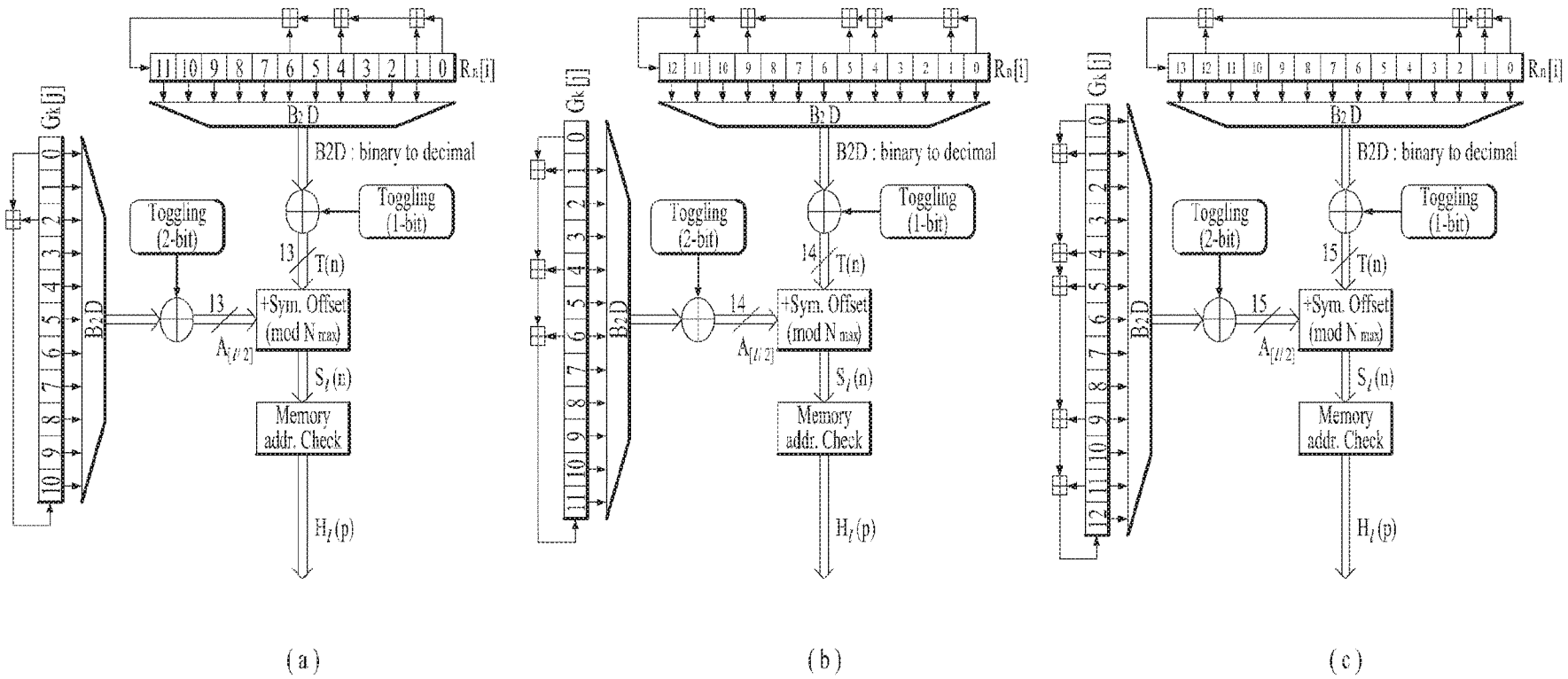
FIG. 10 is a block diagram of an interleaving address generator including a main-PRBS generator and a sub-PRBS generator according to each FFT mode, included in the frequency interleaver, according to an embodiment of the present invention.

FIG. 10 is a block diagram of an interleaving address generator including a main-PRBS generator and a sub-PRBS generator according to each FFT mode, included in the frequency interleaver, according to an embodiment of the present invention.

(a) is a block diagram of an interleaving address generator with respect to a 8K FFT mode, (b) is a block diagram of an interleaving address generator with respect to a 16K FFT mode, and (c) is a block diagram of an interleaving address generator with respect to a 32K FFT mode.

An interleaving procedure with respect to an OFDM symbol pair may use one interleaving sequence and will be described below. First, an available data cell (output cell from a cell mapper) to be interleaved in one OFDM symbol $O_{m,l}$ may be defined as $O_{m,l}=[x_{m,l,0}, \ldots, x_{m,l,p}, \ldots, x_{m,l,Ndata-1}]$ with respect to $l=0, \ldots, N_{sym}-1$. In this case, $x_{m,l,p}$ may be a $p^{th}$ cell of a $l^{th}$ OFDM symbol in a $m^{th}$ frame and $N_{data}$ may be the number of data cells. In the case of a frame signaling symbol, $N_{data}=C_{FSS}$, in the case of normal data, $N_{data}=C_{data}$, and in the case of a frame edge symbol, $N_{data}=C_{FES}$. In addition, the interleaving data cell may be defined as $P_{m,l}=[v_{m,l,0}, \ldots, v_{m,l,Ndata-1}]$ with respect to $l=0, \ldots, N_{sym}-1$.

With respect to an OFDM symbol pair, an interleaved OFDM symbol pair may be given according to $v_{m,l,p})=x_{m,l,p}$, $p=0, \ldots, N_{data}-1$ for a first OFDM symbol of each pair and given according to $v_{m,l,p}=x_{m,l,Hi(p)}$, $p=0, \ldots, N_{data}-1$ for a second OFDM symbol of each pair. In this case, $H_l(p)$ may be an interleaving address generated based on a cyclic shift value (symbol offset) of a PRBS generator and a sub-PRBS generator.

FIG. 11 is a diagram showing a configuration of HTML-Enabled Location Description (HELD).

Terms used in description of an embodiment of the present invention can be defined as follows.

Application Context Identifier can indicate a unique URI that determines which resource is provided by a receiver to a broadcasting state application. Resources may be associated with a plurality of application context identifiers. However, one broadcaster application may be associated with only one application context identifier.

Broadcaster Application can be used to refer to functions included in a set of files provided from a broadcaster within broadcast services. Here, a file may include an HTML5 document, an entry page, other HTML5, CSS, JavaScript, images and/or multimedia resources directly/indirectly referred to by the aforementioned documents. A set of files constituting a broadcaster application can be transmitted over a web and can be transmitted through broadcasting as a package using the ROUTE protocol.

The entry page is the first HTML5 document referred to by application signaling and may represent a document that needs to be initially loaded to a user agent. The entry page may correspond to one of files in an entry package.

The entry package may include one or more files including functions of the broadcaster application. The entry package includes an entry page and may include files such as JavaScript, CSS, image files and other content.

HELD according to an embodiment of the present invention describes the location of an HTML entry page. HELD according to another embodiment may describe information about the HTML entry page.

HELD according to an embodiment of the present invention may be included in service layer signaling.

HELD according to an embodiment of the present invention may correspond to a root element, and the HELD (HELD element) may include one or more HTMLEntryPage elements. The HELD element may include HTML entry page collection elements. The HTMLEntryPage element may include information about properties of the entry page.

The HTMLEntryPage element according to an embodiment of the present invention may include @appContextID, @requiredCapabilities, @appRendering, @entryURL, @alternateEntryURL, @packageURL, @validFrom, @validUntil, @coupledServices and/or an LCT element.

@appContextID can define an application context identifier for this entry page. This attribute can identify an application.

@requiredCapabilities can represent device capabilities required for meaningful rendition of the entry page.

@appRendering can indicate, for a linear service, a broadcaster request that the broadcaster application be allowed to render the presentable component of the service.

@entryURL can specify the URL of the entry page of the application.

@alternateEntryURL can specify an alternative broadband path to the same HTML page indicated in @entryURL.

@packageURL can indicate, if present, the URL of a package containing the entry page. This URL may have a Content-Location value given in @entryURL.

@validFrom can indicate a date and time when the page is loaded. This attribute can indicate that the page at @entryURL is to be loaded at the date and time indicated by this attribute, or at any time after the date and time indicated by this attribute and before the date and time indicated by @validUntil when the service is selected.

@validUntil can indicate a date and time when the application (the page) is unloaded. This attribute can indicate that the application is to be unloaded at the date and time indicated by this attribute.

@coupledServices can provide a space-separated list of linear services sharing a common broadcaster application.

The LCT (Layered Coding Transport) element can describe information about an LCT channel which carries application-related files, such as an application entry page, files associated with the entry page, media assets expected to be consumed by the application, or packages of these files.

The LCT element according to an embodiment of the present invention may include @tsiRef and/or a DistributionWindow element.

@tsiRef can indicate a TSI (Transport Session Identifier) value of the LCT channel. According to an embodiment of the present invention, this attribute can be called @lctTSIRef and included in the DistributionWindow element which will be described below. When this attribute is included in the DistributionWindow element, this attribute can indicate a space-separated list of TSI values of the LCT channel which carries a file associated with the application for the instance of the DistributionWindow element.

The DistributionWindow element can describe information about a broadcast transmission interval and/or a broadcast transmission time frame of application related files. Each instance of this element can define a single time interval in which an application related file is transmitted within the LCT channel identified by @tsiRef. A media asset file transmitted for the distribution window can be expected to be requested by the broadcaster application at a future time generated between @validFrom and validUntil when @validFrom and validUntil are present.

The DistributionWindow element according to an embodiment of the present invention may include @distWindowID, @startTime, @endTime, @dwFilterCode, @dwFCexpire, a FileURL element, @fileFilterCode and/or @fileFCexpire.

@distWindowID can indicate the distribution window. This attribute has a unique value within a scope of a given broadcaster within a given time frame. According to an embodiment of the present invention, this attribute may be called @appContentLabel which will be described below. This attribute can indicate a label or an alias for application related files transmitted for one instance of the DistributionWindow element. That is, this attribute can identify an instance of the DistributionWindow element. Distribution window instances identified by the same @appContentLabel value can deliver the same application related file. The scope within which this attribute has a unique value can be determined by a broadcaster application related to the instance of the DistributionWindow element within an interval (t1, t2). Here, t1 can indicate a start time of first generation of the DistributionWindow element having the @appContentLabel value and t2 can indicate an end time of the broadcaster application (HTMLEntryPage@validUntil value of the entry page of the application).

@startTime can describe a start time of the distribution window. This attribute can correspond to a conditional essential dataTime attribute. This attribute can indicate a start time of the instance of the DistributionWindow element.

@endTime can describe the end time of the distribution window. This attribute corresponds to a conditional essential dataTime attribute. This attribute can indicate the end time of the instance of the DistributionWindow element. This attribute can indicate a future date and/or time related to a time when the HELD, the DWD fragment and/or the instance of the DistributionWindow element are initially inserted into the signal. (Time-shifted content played back by a DVR or the like can have past @endTime.)

@dwFilterCode can indicate a white-space-separated list of integers associated with application content items broadcast during the affiliated instance of DistributionWindow. The meaning of each filter code integer is proprietary to the broadcaster and can be determined by the broadcaster. This attribute can indicate a list of filter codes associated with a given device, and the list can be retrieved by an API such as GetdwFiltersAPI( ). This attribute can be used by the receiver platform in order to determine whether the content is downloaded and stored by a broadcaster application to be used in the future. This attribute can be used by the receiver platform in order to determine whether content available during the distribution window corresponds to content in which the device is interested.

@dwFCexpire can indicate the expiration date/time for @dwFilterCode.

The FileURL element can indicate the URL of the application-related document (file) to be delivered during the instance of the distribution window element. Each instance of this element having a conditional essential anyURI attribute can indicate the identifier of the application-related file to be delivered during the distribution window in the form of a relative URL. The matched value of the Content-Location attribute of the EFDT for this element can be used to identify the file object corresponding to the application-related file using a TOI value mapped to the Content-Location.

The FileURL element according to an embodiment of the present invention can include @fileFilterCode and/or @fileFCexpire.

@fileFilterCode can indicate a white-space-separated list of integers representing filter codes that apply to this file. The list of filter codes associated with a given device can be retrieved by an API such as GetFileFiltersAPI( ). This attribute can indicate a white-space-separated list of integers representing filter codes associated with the FileURL element.

@fileFCexpire can indicate the expiration date/time for @fileFilterCode.

According to another embodiment of the present invention, the DistributionWindow element may be included in an independent DWD (Distribution Window Description) fragment which is not included in the HELD element and transmitted.

FIG. 12 is a diagram showing a usage example of the HELD according to an embodiment of the present invention.

This usage example is based on the condition that applications are distributed and signaled for receivers for the same distribution time with different identifiers and the condition that application content items are distributed and signaled with different filter codes.

According to this usage example, an entry page having entryUrl="/p1/index.html" is an entry page for an application identified by appContextID="A.xyz.com" and can be loaded until the date and time indicated by validUntil="2016-07-17T09:30:47Z". In addition, this entry page is transmitted over an LCT channel identified by tsiRef="10". This entry page can be transmitted during the distribution window identified by distWindowID="100", and this distribution window can start at the date and time indicated by startTime="2016-07-17T00:00:00Z" and end at the date and time indicated by endTime="2016-07-17T00:15:00Z". This distribution window has properties indicated by dwFilterCode="5 8 17". During this distribution window, a filter having properties corresponding to fileFilterCode="5" and identified by FileURL image/logo1.jpg, a file having properties corresponding to fileFilterCode="8" and identified by FileURL movie/logo2.mp4 and a file having properties corresponding to fileFilterCode="17" and identified by FileURL movie/logo3.mp4 may be transmitted. Furthermore, the application identified by appContextID="A.xyz.com" may further include the entry page having entryUrl="/p2/index.html", and this entry page can be loaded at the date and time indicated by validFrom="2016-07-17T09:30:47Z" and unloaded at the date and time indicated by validUntil="2016-07-17T12:00:47Z".

FIG. 13 is a diagram showing a configuration and a usage example of DWD (Distribution Window Description) according to an embodiment of the present invention.

A DWD fragment according to an embodiment of the present invention may include one or more instances of the DistributionWindow element. The DWD fragment can indicate that one or more application-related files are scheduled to be transmitted through ROUTE in the future. An application-related file may refer to a combination of an HTML5 entry page and/or a document of a broadcaster application (e.g., JavaScipt, CSS, XML, media files, or the like). A receiver may tune to and/or join in an appropriate broadcast stream and an LCT channel through which the application-related files are broadcast for the distribution window time frame in order to download and store the content.

According to an embodiment of the present invention, a combination of application files may be broadcast for a plurality of distribution windows in order to increase the possibility of successful reception of a receiver interested in the application files. This is because the receiver may not tune to an appropriate broadcast stream and/or an LCT channel for one given distribution window instance. For example, a receiver having a single tuner can be activated and tuned to another service during one given distribution window. However, this receiver may not be activated for instances after a distribution window during which the same content is transmitted.

According to an embodiment of the present invention, a set of one or more application-related files transmitted for one instance of the DistributionWindow element (for a time interval from DistributionWindow @startTime to DistributionWindow@endTime) can be identified by a DistributionWindow@appContentLabel attribute value. One or more application-related files having the same label and transmitted for one or more instances of the DistributionWindow element (one or more application-related files having the same @appContentLabel value and different time windows) may be identical. That is, the one or more application-related files may include the same object.

According to an embodiment of the present invention, the DWD fragment may include distribution window instances having a plurality of @appContentLabel values (e.g., label (i) for time intervals (t1, t2), (t3, t4) and (t5, t6), label(j) for interval (t7, t8) and label(k) for intervals (t9, t10) and (t11, t12), with ti<tj for j>i). This can allow a broadcaster to provide the application-related content for other distribution windows and allow a receiver to avoid participation in a plurality of distribution windows for which the same content is transmitted.

According to an embodiment of the present invention, each distribution window instance under each instance of the AppContextID element may include @dwFilterCode including one or more filter codes. A filter code may have a unique integer value within a given instance of the AppContextID element. Filter codes may be generated by broadcasters to represent a personalization category defined by each broadcaster. For example, different filter code values can be allocated to a category such as a truck owner, a sustaining member or a zip code.

According to an embodiment of the present invention, a filter code may be associated with an application-related file. In ROUTE transmission, identification of an application-related file associated with a filter code can be provided by @fileFilterCode of EFDT. A receiver may have internally-stored filter code values provided by a broadcaster application. Here, the receiver may have filter code values stored therein using an API such as Set Filters API. A filter code associated with a file can be compared with internally-stored filter codes in order to aid in determining whether the given file is associated with personalization.

According to an embodiment of the present invention, @dwFilterCode can indicate linked lists of all filter codes for application-related files available for the distribution window. Filter codes in @dwFilterCode can be compared with filter codes stored in the receiver in order to aid in determining whether the receiver participates in a given distribution window instance. That is, the filter codes in @dwFilterCode can be compared with the filter codes stored in the receiver in order to aid in determining whether the receiver participates in content reception activated for the broadcast stream and/or the LCT channel for the given distribution window instance. When one or more filter codes in @dwFilterCode are matched to one or more filter codes stored in the receiver, the receiver can determine that at least one filer is associated with personalization.

According to an embodiment of the present invention, even though there is no filter code associated with a distribution window instance, for example, @dwFilterCode is not present and/or the receiver does not have internally-stored available filter codes, the receiver can participate in the distribution window and download application-related files. However, use of filter codes can avoid storage of unrelated data and provide a larger amount of spaces for related data to optimize the memory space of the receiver.

The DWD fragment according to an embodiment of the present invention may include the DistributionWindow element, @appContentLabel, @startTime, @endTime, @lctTSIRef and/or an AppContextId element. The AppContextId element may include @dwFilterCode.

The DistributionWindow element, @startTime, @endTime and @dwFilterCode have been described above, @appContentLabel may have the same meaning as the above-described @distWindowID, and @lctTSIRef may have the same meaning as the above-described @tsiRef.

The AppContextId element can define an application context identifier for the set of distribution window filter codes. This element can indicate the application content identifier as a URI value. An application content identifier can identify an application resource that can be shared by a plurality of broadcaster applications. The resource associated with the broadcaster application and the application context identifier according thereto can be used for another broadcaster application when the two broadcaster application have the same application context identifier.

In this figure, L13010 shows an embodiment of DWD which signals one distribution window along with the start time and end time of the distribution window, one or more LCT channel and an application context identifier. In this figure, the distribution window starts at startTime="2016-07-17T12:00:47Z" and ends at endTime="2016-07-18T12:00:47Z". An application-related file transmitted in the aforementioned time frame of the distribution window can be transmitted over an LCT channel identified by lctTSIRef="43 44". The application-related filter transmitted through the distribution window may be associated with an application identified by <AppContextId>A.xyz.com</AppContextId>.

L13020 of this figure shows an embodiment of DWD in a case of signaling a plurality of distribution windows having different pieces of time slot information and a case of signaling labels for content objects scheduled to be transmitted in different time slots. In the figure, the distribution window identified by appContentLabel="1" starts at startTime="2016-07-17T12:00:47Z" and ends at endTime="2016-07-18T12:00:47Z", the application-related filter transmitted in this distribution window may be transmitted over an LCT channel identified by lctTSIRef="43 44", and the application-related file may be associated with an application identified by <AppContextId>A.xyz.com</AppContextId>. The distribution window identified by appContentLabel="2" starts at startTime="2016-07-18T12:00:47Z" and ends at endTime="2016-07-19T12:00:47Z", the application-related file transmitted in this distribution window may be transmitted over the LCT channel identified by lctTSIRef="43 44", and the application-related file may be associated with the application identified by <AppContextId>A.xyz.com</AppContextId>. The distribution window identified by appContentLabel="1" starts at startTime="2016-07-19T12:00:47Z" and ends at endTime="2016-07-20T12:00:47Z", the application-related transmitted in this distribution window may be transmitted over the LCT channel identified by lctTSIRef="43 44", and the application-related file may be associated with the application identified by <AppContextId>A.xyz.com</AppContextId>. The distribution window identified by appContentLabel="2" starts at startTime="2016-07-20T12:00:47Z" and ends at endTime="2016-07-21T12:00:47Z", the application-related transmitted in this distribution window may be transmitted over the LCT channel identified by lctTSIRef="43 44", and the application-related file may be associated with the application identified by <AppContextId>A.xyz.com</AppContextId>.

L13030 of this figure shows an embodiment of DWD in a case in which filter codes of application-related files distributed during an available time slot for each distribution window instance are signaled. In the figure, the distribution window identified by appContentLabel="1" starts at startTime="2016-07-17T12:00:47Z" and ends at endTime="2016-07-18T12:00:47Z", the application-related files transmitted in this distribution window may be transmitted over the LCT channel identified by lctTSIRef="43 44", and the application-related file may be associated with the application identified by <AppContextId>A.xyz.com</AppContextId> and have filtering properties corresponding to dwFilterCode="1 2 3". The distribution window identified by appContentLabel="1" starts at startTime="2016-07-18T12:00:47Z" and ends at endTime="2016-07-19T12:00:47Z", the application-related files transmitted in this distribution window may be transmitted over the LCT channel identified by lctTSIRef="43 44", and the application-related file may be associated with the application identified by <AppContextId>A.xyz.com</AppContextId> and have filtering properties corresponding to dwFilterCode="1 2 3". The distribution window identified by appContentLabel="2" starts at startTime="2016-07-18T12:00:47Z" and ends at endTime="2016-07-19T12:00:47Z", the application-related files transmitted in this distribution window may be transmitted over an LCT channel identified by lctTSIRef="45 46", and the application-related file may be associated with the application identified by <AppContextId>A.xyz.com</AppContextId> and have filtering properties corresponding to dwFilterCode="4 5 6".

According to an embodiment of the present invention, the receiver can first filter the distribution window using @dwFilterCode of DWD. That is, the receiver can perform filtering of the distribution window prior to reception of a filter corresponding to filtering. Accordingly, the receiver can filter out the distribution window upon determining that a file that a user desires is not transmitted during the distribution window. In addition, the receiver may not receive and/or parse files to be transmitted during the filtered-out distribution window.

According to an embodiment of the present invention, @dwFilterCode of DWD is a list of one or more filter code values, and the receiver may not recognize the meaning of each filter code. Each filter code value may be managed by broadcasters. Accordingly, identification information of each filter code may not need to be signaled.

According to an embodiment of the present invention, an additional signaling table for filter filtering may not be transmitted by signaling @dwFilterCode in DWD.

Figure 14:
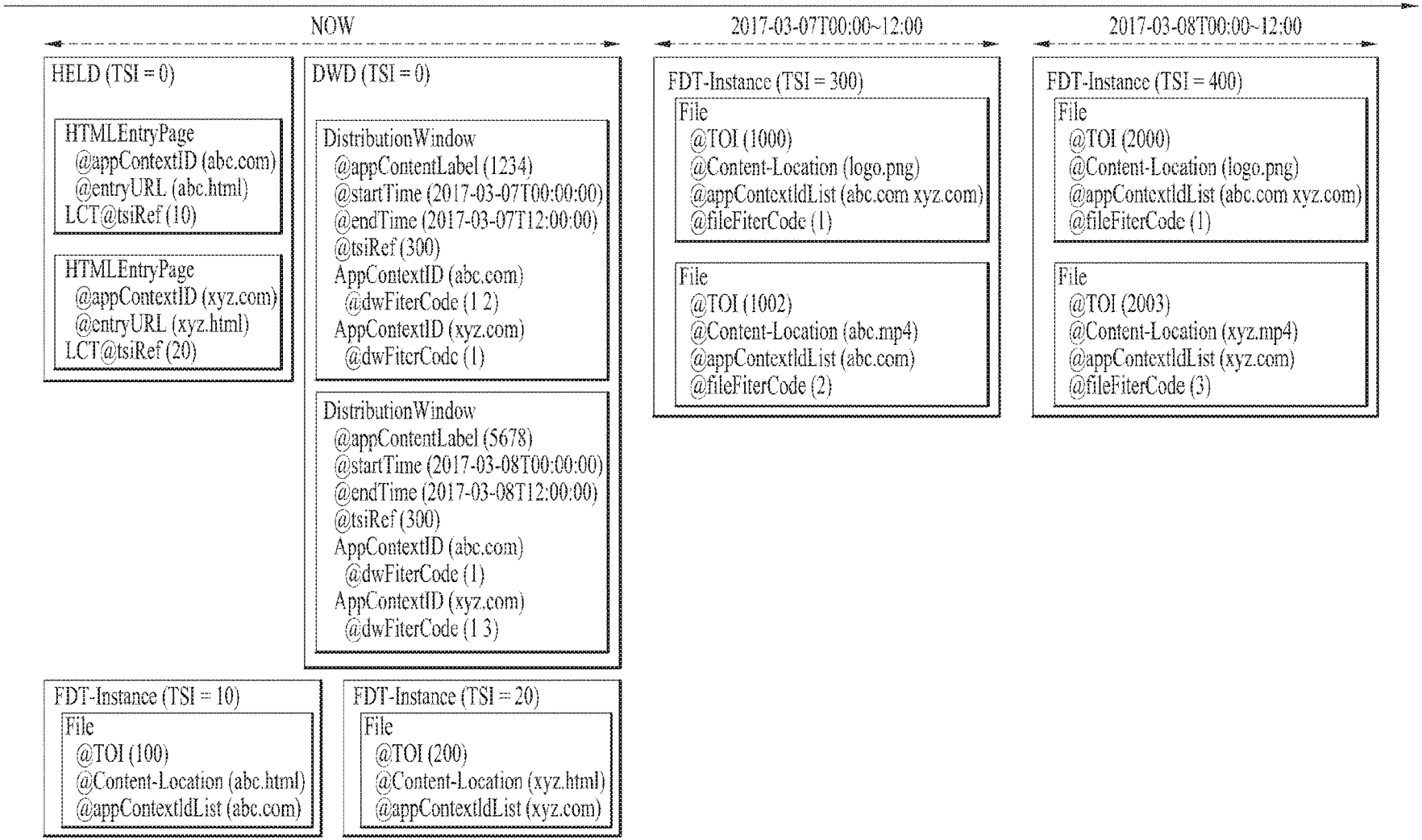
FIG. 14 is a diagram showing HELD, DWD and an embodiment of an extended file delivery table (EFDT) according to an embodiment of the present invention.

FIG. 14 is a diagram showing an embodiment of HELD, DWD and an EFDT (Extended File Delivery Table) according to an embodiment of the present invention.

According to an embodiment of the present invention, HELD and DWD can be transmitted through an LCT channel corresponding to TSI=0 at present. The HELD can signal @entryURL (abc.html) which is the URL of the entry page of application @appContextID (abc.com) and LCT@tsiRef (10) which is the TSI value of the LCT channel over which the entry page is transmitted. In addition, the HELD can signal @entryURL (xyz.html) which is the URL of the entry page of application @appContextID (xyz.com) and LCT@tsiRef (20) which is the TSI value of the LCT channel over which the entry page is transmitted.

The DWD can signal start time @startTime (2017-03-07T00:00:00) at which distribution window @appContentLabel (1234) during which files having properties of @dwFilterCode (1 2) of application AppContextID (abc.com) and files having properties of @dwFilterCode (1) of application AppContextID (xyz.com) are transmitted starts, end time @endTime (2017-03-07T12:00:00) and a TSI value @tsiRef (300) of an LCT channel over which the distribution window is transmitted. In addition, the DWD can signal start time @startTime (2017-03-08T00:00:00) at which distribution window @appContentLabel (5679) during which files having properties of @dwFilterCode (1) of application AppContextID (abc.com) and files having properties of @dwFilterCode (1 3) of application AppContextID (xyz.com) are transmitted starts, end time @endTime (2017-03-08T12:00:00) and a TSI value @tsiRef (400) of an LCT channel over which the distribution window is transmitted.

According to an embodiment of the present invention, a file with respect to the entry page @entryURL (abc.html) of the application @appContextID (abc.com) and FDT (File Description Table)-Instance for the file can be currently transmitted over the LCT channel corresponding to TSI=10. The FDT-Instance can signal @TOI (100), @Content-Location (abc.html) and @appContextIdList (abc.com) of the file that carries the entry page. Furthermore, a file with respect to the entry page @entryURL (xyz.html) of the application @appContextID (xyz.com) and FDT (File Description Table)-Instance for the file can be transmitted over the LCT channel corresponding to TSI=20. The FDT-Instance can signal @TOI (200), @Content-Location (xyz.html) and @appContextIdList (xyz.com) of the file that carries the entry page.

According to an embodiment of the present invention, a file having @TOI (1000), @Content-Location (logo.png), @appContextIdList (abc.com xyz.com) and @fileFilterCode (1), a file having @TOI (1002), @Content-Location (abc.mp4), @appContextIdList (abc.com) and @fileFilterCode (2), and FDT-Instance that describes the files can be transmitted over the LCT channel corresponding to TSI=300 for a time (2017-03-07T00:00~12:00) corresponding to distribution window @appContentLabel (1234) which will arrive in the future. Furthermore, a file having @TOI (2000), @Content-Location (logo.png), @appContextIdList (abc.com xyz.com) and @fileFilterCode (1), a file having @TOI (2003), @Content-Location (xyz.mp4), @appContextIdList (xyz.com) and @fileFilterCode (3), and FDT-Instance that describes the files can be transmitted over the LCT channel corresponding to TSI=400 for a time (2017-03-08T00:00~12:00) corresponding to distribution window @appContentLabel (5679) which will arrive in the future.

Figure 15:
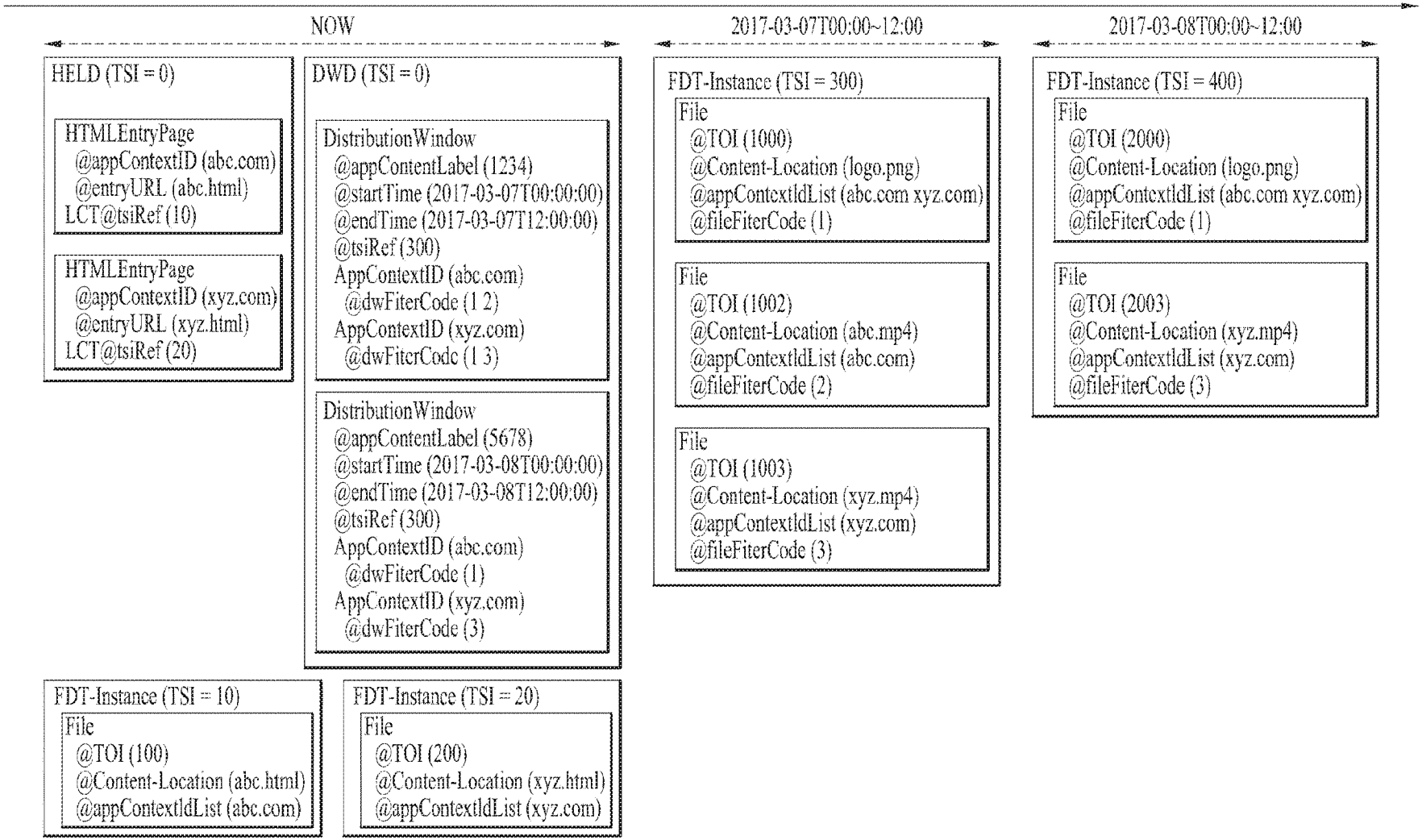
FIG. 15 is a diagram showing HELD, DWD and EFDT according to another embodiment of the present invention.

FIG. 15 is a diagram showing an embodiment of HELD, DWD and an EFDT (Extended File Delivery Table) according to another embodiment of the present invention.

Distribution window @appContentLabel (1234) of the DWD according to an embodiment of the present invention can signal transmission information about files having properties of @dwFilterCode (1 3) of the application AppContextID (xyz.com) and distribution window @appContentLabel (5678) can signal transmission information about files having properties of @dwFilterCode (3) of the application AppContextID (xyz.com).

Accordingly, a file having @TOI (1003), @Content-Location (xyz.mp4), @appContextIdList (xyz.com) and @fileFilterCode (3) can be additionally transmitted over the LCT channel corresponding to TSI=300 for a time (2017-03-07T00:00~12:00) corresponding to the distribution window @appContentLabel (1234) which will arrive in the future.

Figure 16:
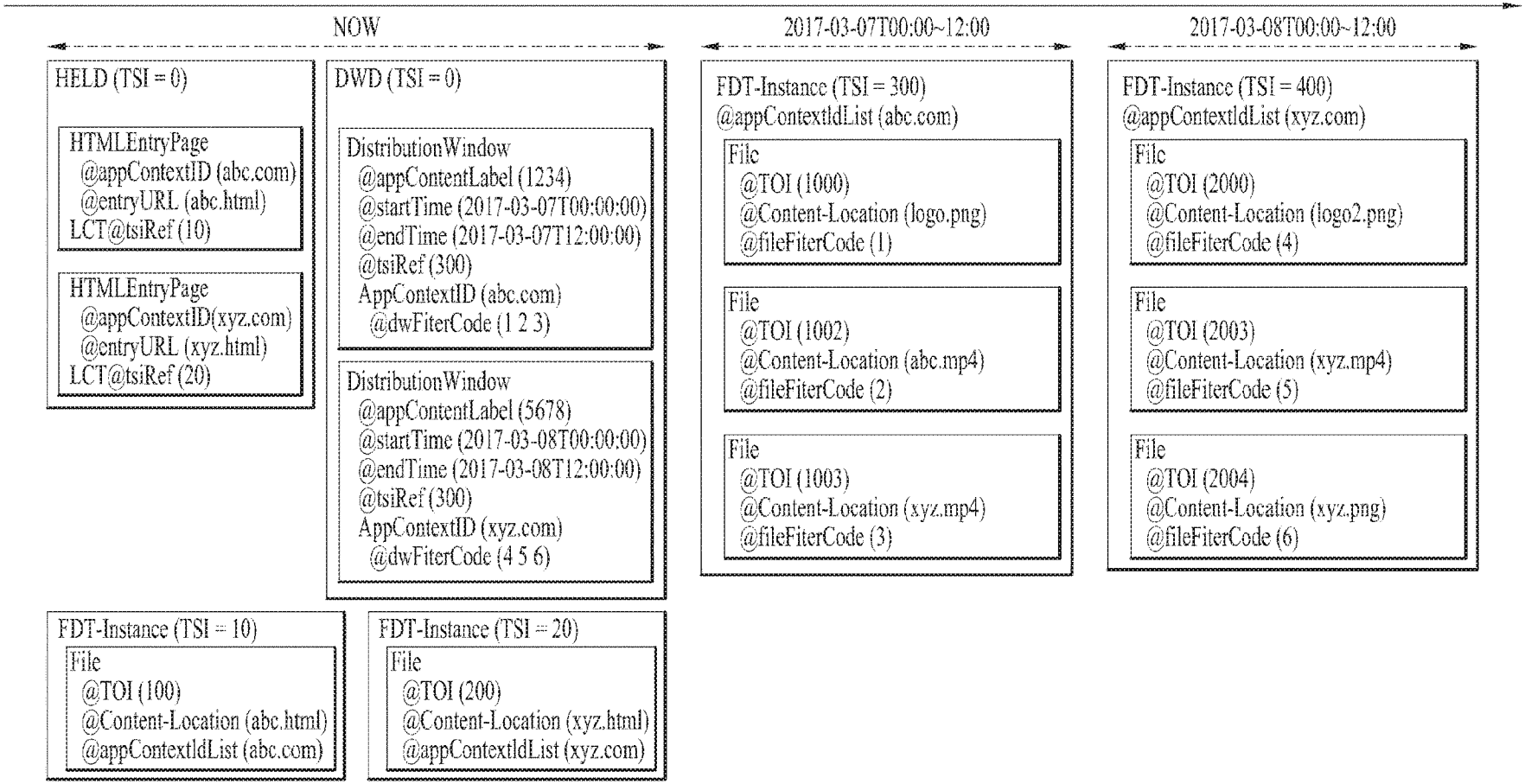
FIG. 16 is a diagram showing HELD, DWD and EFDT according to another embodiment of the present invention.

FIG. 16 is a diagram showing an embodiment of HELD, DWD and an EFDT (Extended File Delivery Table) according to another embodiment of the present invention.

Distribution window @appContentLabel (1234) of the DWD according to an embodiment of the present invention can signal transmission information about files having properties of @dwFilterCode (1 2 3) of the application AppContextID (abc.com) and signal transmission information about files having properties of @dwFilterCode (4 5 63) of the application AppContextID (xyz.com).

Accordingly, a file having @TOI (1000), @Content-Location (logo1.png) and @fileFilterCode (1), a file having @TOI (1002), @Content-Location (abc.mp4) and @fileFilterCode (2) and a file having @TOI (1003), @Content-Location (abc.png) and @fileFilterCode (3) for the application @appContextIdList (abc.com), and FDT-Instance that describes the files can be transmitted over the LCT channel corresponding to TSI=300 for a time (2017-03-07T00:00~12:00) corresponding to the distribution window @appContentLabel (1234) which will arrive in the future. Furthermore, a file having @TOI (2000), @Content-Location (logo2.png) and @fileFilterCode (4), a file having @TOI (2003), @Content-Location (xyz.mp4) and @fileFilterCode (5) and a file having @TOI (2004), @Content-Location (xyz.png) and @fileFilterCode (6) for the application @appContextIdList (xyz.com), and FDT-Instance that describes the files can be transmitted over the LCT channel corresponding to TSI=400 for a time (2017-03-08T00:00~12:00) corresponding to the distribution window @appContentLabel (5679) which will arrive in the future.

Figure 17:
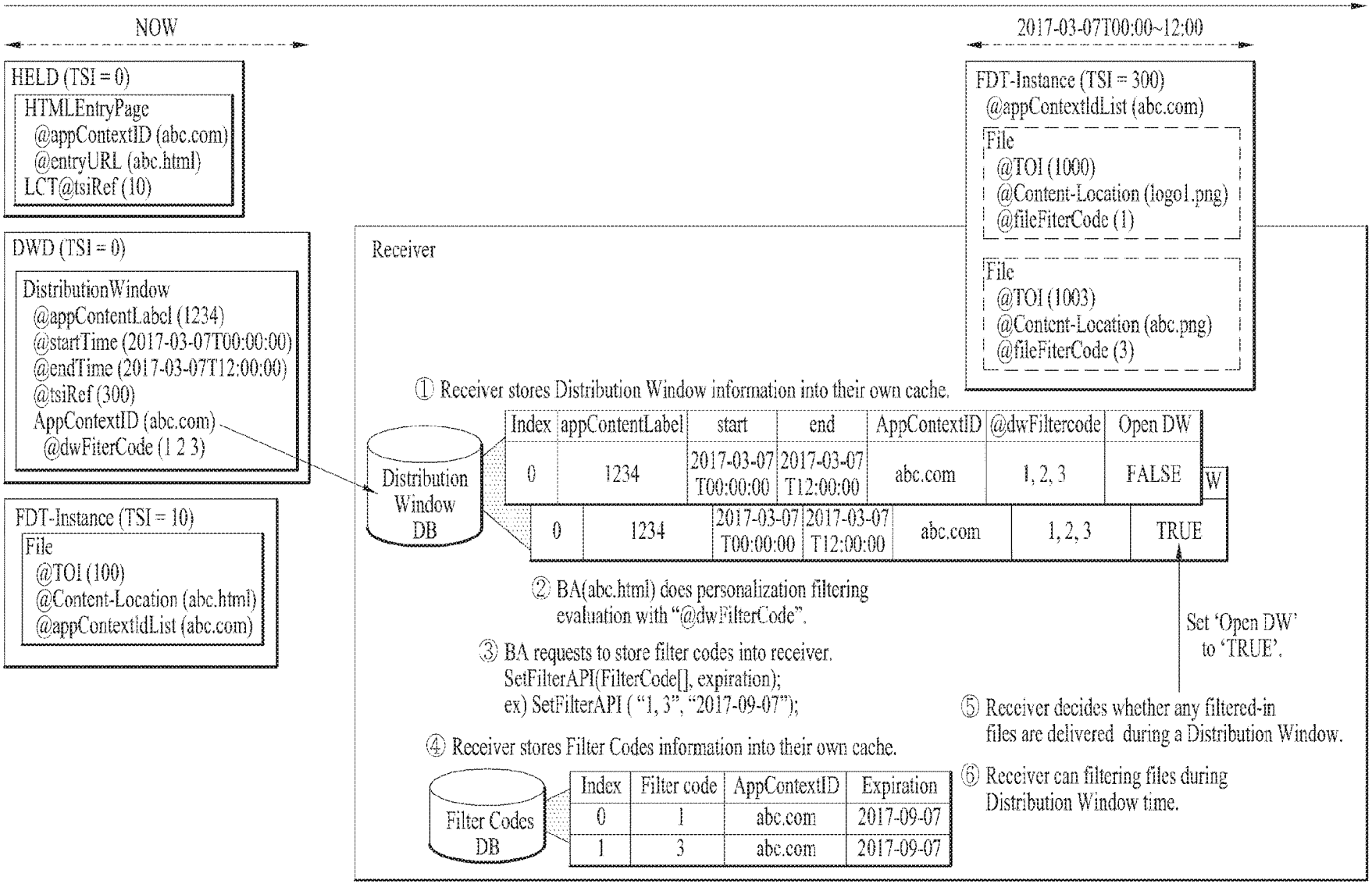
FIG. 17 is a diagram showing an operation of a receiver using HELD, DWD and EFDT according to an embodiment of the present invention.

FIG. 17 is a diagram showing an operation of a receiver using HELD, DWD and EFDT according to an embodiment of the present invention.

According to an embodiment of the present invention, HELD and DWD can be currently transmitted over the LCT channel corresponding to TSI=0 and the file and FDT-Instance can be transmitted over the LCT channel corresponding to TSI=10.

(1) The receiver may store received information about a distribution window in a distribution window database in a cache. The distribution window database may store indexes, appContentLabel, start time, end time, AppContextID and @dwFiltercode of distribution windows, and information about whether distribution windows have been activated.

(2) A broadcaster application (BA) can perform personalization filtering evaluation using @dwFilterCode stored in the distribution window database in the receiver.

(3) The BA can request storage of filter codes in the receiver. The BA can store filter codes in the receiver using SetFilterAPI (FilterCode[ ], expiration). For example, SetFilterAPI ("1,3", "2017-09-07") means that filter code 1 and filter code 3 which end at 2017-09-07 are stored in the receiver.

(4) The receiver can store filter codes in a filter code database in the cache. The filter code database may store information about indexes, Filter codes, AppContextID and Expiration of filter codes.

(5) The receiver can set an item indicating whether a distribution window is activated in the distribution window database to "TRUE" or "FALSE" to determine whether a filtered file is transmitted during the distribution window.

(6) The receiver can filter the file during the distribution window. The receiver can compare information stored in the filter code database with information stored in the distribution window database to perform filtering and receive the filtered file.

According to the embodiment illustrated in this figure, a file having @fileFilterCode (2) (@TOI (1002), @Content-Location (abc.mp4)) can be filtered out and only a file having @fileFilterCode (1) (@TOI (1000), @Content-Location (logo1.png)) and a file having @filterFilterCode (3) (@TOI (1002), @Content-Location (abc.mp4)) can be filtered-in and received during the distribution window @appContentLabe (1234).

FIG. 18 is a diagram showing an operation of a receiver using HELD, DWD and EFDT according to another embodiment of the present invention.

According to an embodiment of the present invention, the DWD can be transmitted over the LCT channel corresponding to TSI=0 and the DWD can describe the content of the distribution window @appContentLabel (1234) and the distribution window @appContentLabel (5679).

(1) The receiver can store information about a received distribution window in the distribution window database in the cache. The distribution window database may store indexes, appContentLabel, start time, end time and AppContextID/Filtercode of distribution windows, and information about whether distribution windows have been activated.

(2) The receiver can store information about filter codes in the filter code database in the cache. The filter code database may store information about indexes, Filter codes, AppContextID, Expiration and Filter-in of filter codes.

(3) A BA can perform personalization filtering evaluation using information stored in the filter code database.

(4) The BA can request setting of a Filter-in item of the filter code database to "TRUE (as filtered-in)" or "FALSE (as filtered-out)". The BA can set Filter-in item values of filter codes using SetFilterAPI (appContextID, FilterCode[ ], Boolean, expiration). For example, SetFilterAPI ("xyz.com", "3", "TRUE", "2017-09-07") means that the expiration date of a filter code that expires on 2017-09-07 and has FilterCode="3" and appContextID="xyz.com" is set to "2017-09-07" and the Filter-in item is set to "TRUE".

(5) The receiver can set the item indicating whether a distribution window is activated in the distribution window data to "TRUE" or "FALSE" to determine whether the distribution window is activated. The corresponding file can be received through the activated distribution window.

According to an embodiment of the present invention, the filter code having FilterCode="3" and AppContextID="xyz.com" in the filter code database is set to be filtered in and thus the distribution window having appContentLable="5678" in the distribution window database is set to be activated. Accordingly, the file having FilterCode="3" associated with xyz.com application can be transmitted during the distribution window.

Figure 19:
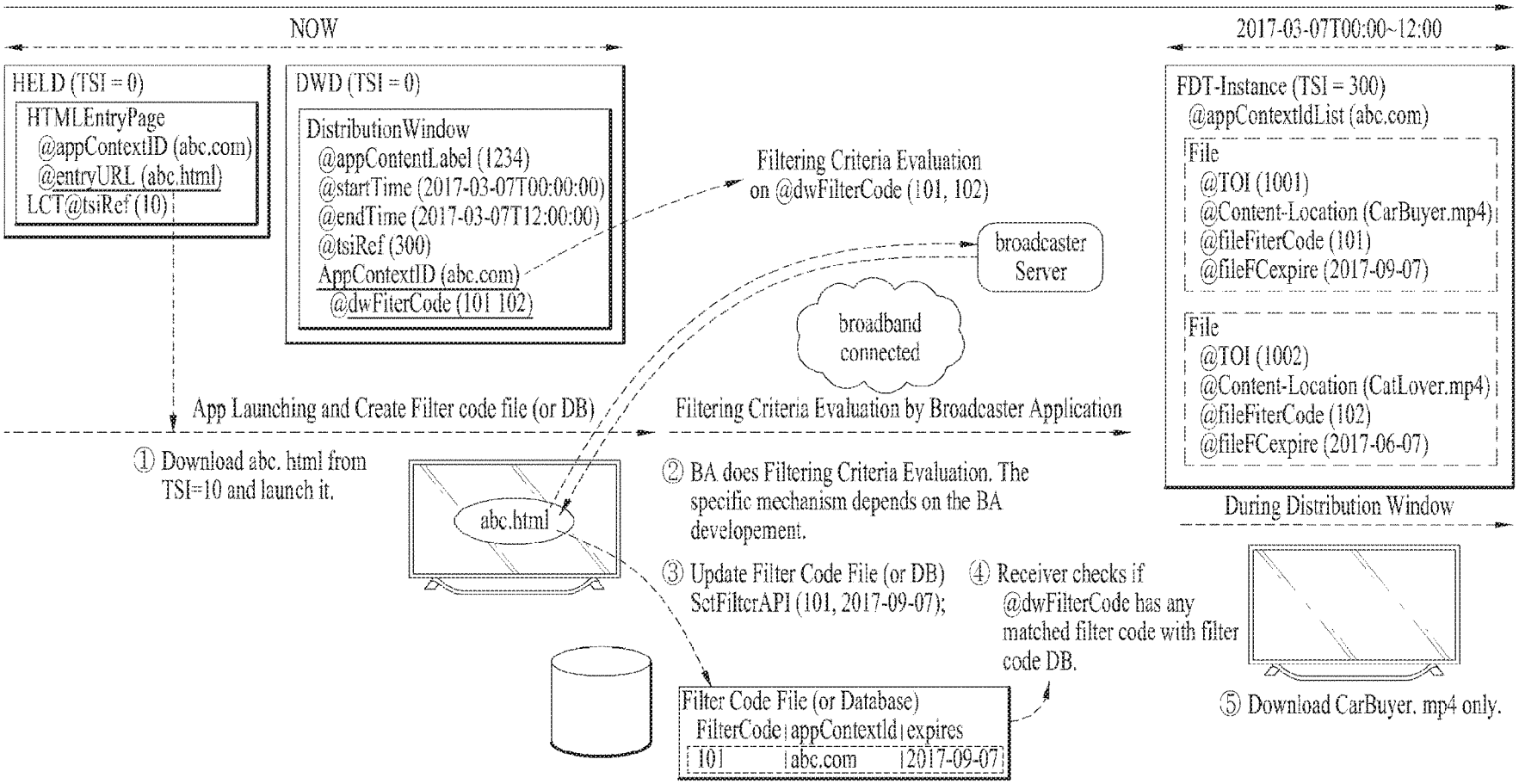
FIG. 19 is a diagram showing a usage example of SetFilterAPI according to an embodiment of the present invention.

FIG. 19 is a diagram showing a usage example of SetFilterAPI according to an embodiment of the present invention.

According to an embodiment of the present invention, HELD which describes the entry page (@appContextID (abc.com), @entryURL (abc.html), LCT@tsiRef (10)) and DWD which describes the distribution window (@appContentLabe (1234), @startTime (2017-03-07T00:00:00), @endTime (2017-03-07T12:00:00), @tsiRef (300), AppContextID (abc.com), @dwFilterCode (101 102)) can be currently transmitted over the LCT channel corresponding to TSI=0.

(1) A receiver can download the entry page @entryURL (abc.html) over the LCT channel corresponding to TSI=10 and execute the same.

(2) A BA can perform filtering criteria evaluation. The BA can perform filtering criteria evaluation for @dwFilterCode (101 102) of the distribution window of the DWD. A specific mechanism of filtering criteria evaluation may depend on how the BA is developed.

(3) The receiver or the BA can update filter code files (filter code database). For example, information about "FilterCode="101" can be stored in the filter code database using SetFilterAPI (101, 2017-09-07). In this case, values of "101", "abc.com" and "2017-09-07" can be stored in FilterCode, appContextID and expires items.

(4) The receiver can compare the filter code described by @dwFilterCode of the DWD with filter codes stored in the filter code database of the receiver to check whether there is a filter code matched to the filter code described by @dwFilterCode.

(5) The receiver or the BA can download a file having FilterCode="101" (@TOI (1001), @Content-Location (CarBuyer.mp4), @filteFilterCode (101), @fileFCexpire (2017-09-07)) which is described in both @dwFilterCode and the filter code database during the distribution window. Here, a file having FilterCode="102" is not a file having a filter code stored in the filter code database of the receiver, and thus this file is not downloaded to the receiver although the file can be broadcast during the distribution window.

Figure 20:
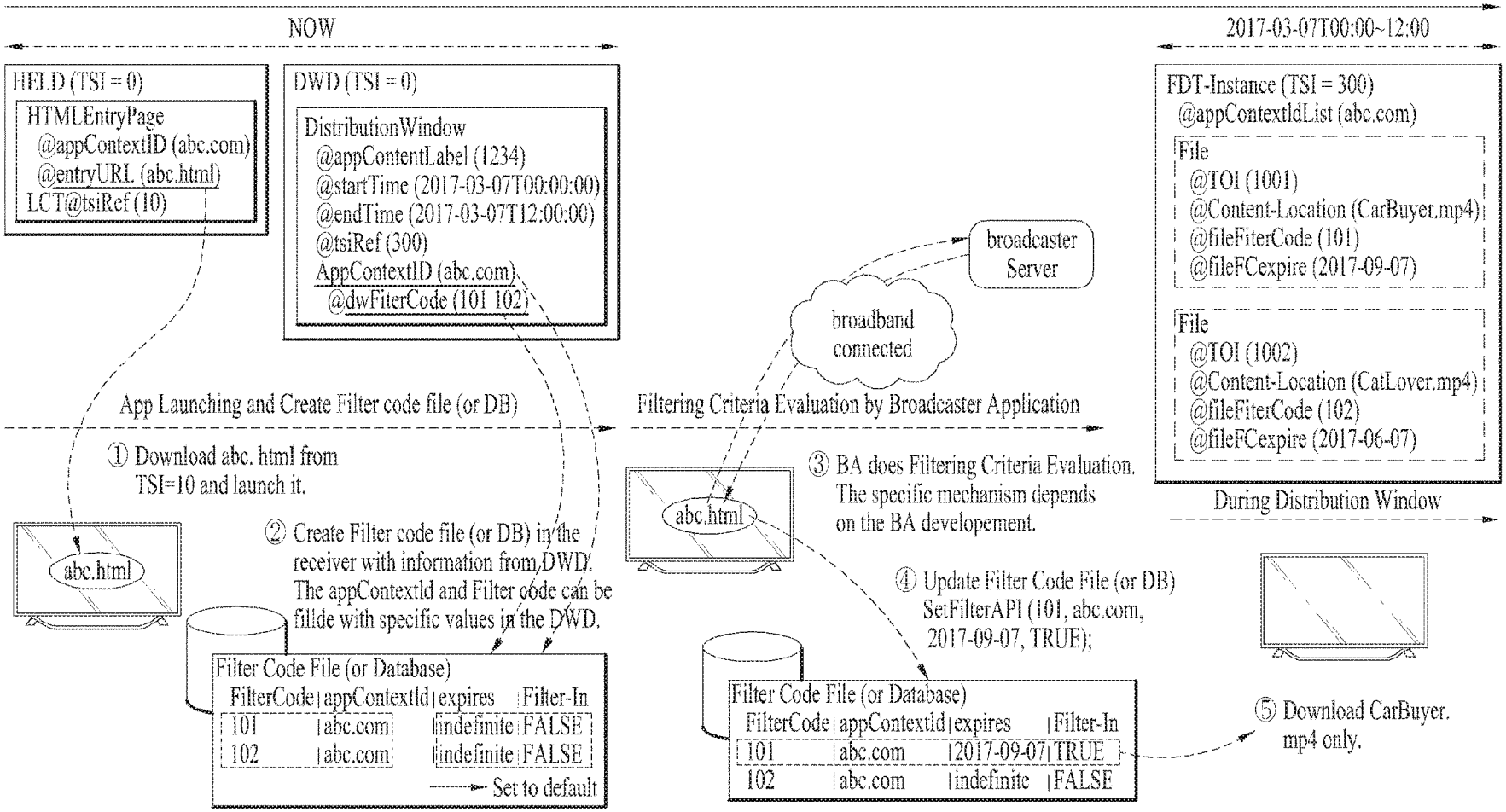
FIG. 20 is a diagram showing a usage example of SetFilterAPI according to another embodiment of the present invention.

FIG. 20 is a diagram showing a usage example of SetFilterAPI according to another embodiment of the present invention.

According to an embodiment of the present invention, DWD which describes the entry page (@appContextID (abc.com), @entryURL (abc.html), LCT@tsiRef (10)) and the distribution window (@appContentLabe (1234), @startTime (2017-03-07T00:00:00), @endTime (2017-03-07T12:00:00), @tsiRef (300), AppContextID (abc.com), @dwFilterCode (101 102)) can be currently transmitted over the LCT channel corresponding to TSI=0.

(1) A receiver may download the entry page corresponding to @entryURL (abc.html) over the LCT channel corresponding to TSI=10 and execute the entry page.

(2) The receiver or a BA may generate filter code files (filter code database) therein using the information described in the received DWD. The filter code database may include FilterCode, appContextId, Expires and Filter-in items. The FilterCode and appContextId items may be set to specific values of @dwFilterCode and AppContextID elements of the DWD. In addition, the Expires and Filter-In items may be set to "indefinite" and "FALSE" as default values.

(3) The BA may perform filtering criteria evaluation. The BA may perform filtering criteria evaluation for @dwFilterCode (101 102) of the distribution window of the DWD. Specific mechanisms of filtering criteria evaluation may depend on how the BA is developed.

(4) The receiver or the BA may update the filter code files (filter code database). For example, the Expires item can be set to "2017-09-07" and the Filter-In item can be set to "TRUE" among items for "FilterCode="101" stored in the filter code database using SetFilterAPI (101, abc.com, 2017-09-07, TRUE).

(5) The receiver or the BA may download a file (@TOI (1001), @Content-Location (CarBuyer.mp4), @filteFilterCode (101), @fileFCexpire (2017-09-07)) having a filter code for which the Filter-In item of the filter code database is set to "TRUE" during the distribution window.

Figure 21:
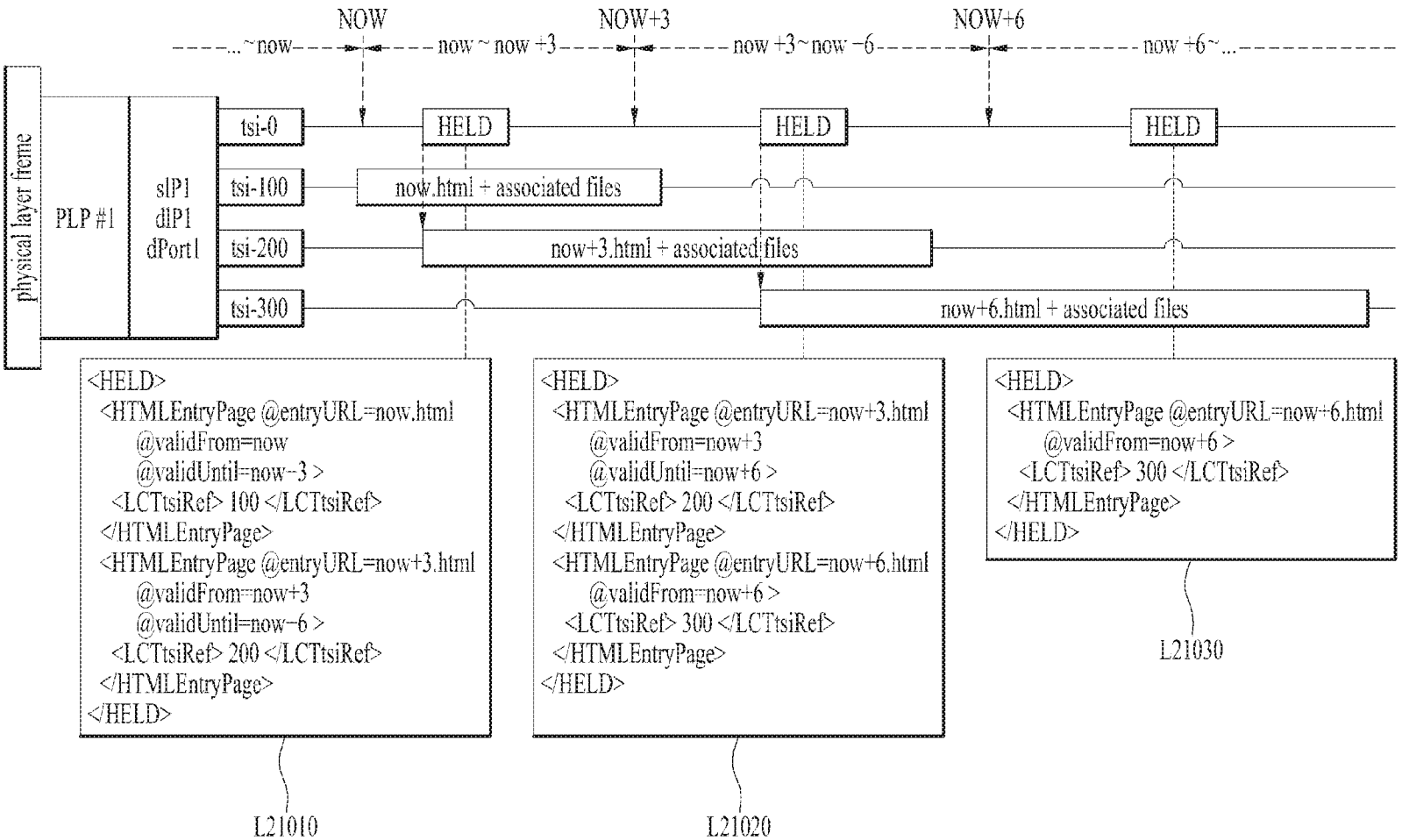
FIG. 21 is a diagram showing when HELD, an entry page and application related files are transmitted according to an embodiment of the present invention.

FIG. 21 is a diagram showing periods of time when HELDs, entry pages and application-related files are transmitted according to an embodiment of the present invention.

According to an embodiment of the present invention, a first HELD L21010 may be transmitted over an LCT channel corresponding to tsi-0 at a time between "now" and "now+3", a second HELD L21020 may be transmitted over the LCT channel corresponding to tsi-0 at a time between "now+3" and "now+6", and a third HELD L21030 may be transmitted over the LCT channel corresponding to tsi-0 at a time after "now+6".

The first HELD L21010 may describe information about a first entry page (@entryURL=now.html, @validFrom=now, @validUntil=now+3, LCTtsiRef=100) and a second entry page (@entryURL=now+3.html, @validFrom=now+3, @validUntil=now+6, LCTtsiRef=200). The first entry page now.html and application-related files associated with the first entry page may be transmitted over an LCT channel corresponding to tsi-100 according to the information described in the first HELD. In addition, the second entry page now+3.html and application-related files associated with the second entry page may be transmitted over an LCT channel corresponding to tsi-200 for a time from when the first HELD is transmitted to "now+6".

The second HELD L21020 may describe information about the second entry page (@entryURL=now+3.html, @validFrom=now+3, @validUntil=now+6, LCTtsiRef=200) and a third entry page (@entryURL=now+6.html, @validFrom=now+6, CTtsiRef=300). The second entry page now+3.html and application-related files associated with the second entry page may be transmitted over the LCT channel corresponding to tsi-200 according to the information described in the second HELD. In addition, the third entry page now+6.html and application-related files associated with the second entry page may be transmitted over an LCT channel corresponding to tsi-300 from when the second HELD is transmitted.

The third HELD L21030 may describe information about the currently transmitted third entry page (@entryURL=now+6.html, @validFrom=now+6, LCTtsiRef=300).

Figure 22:
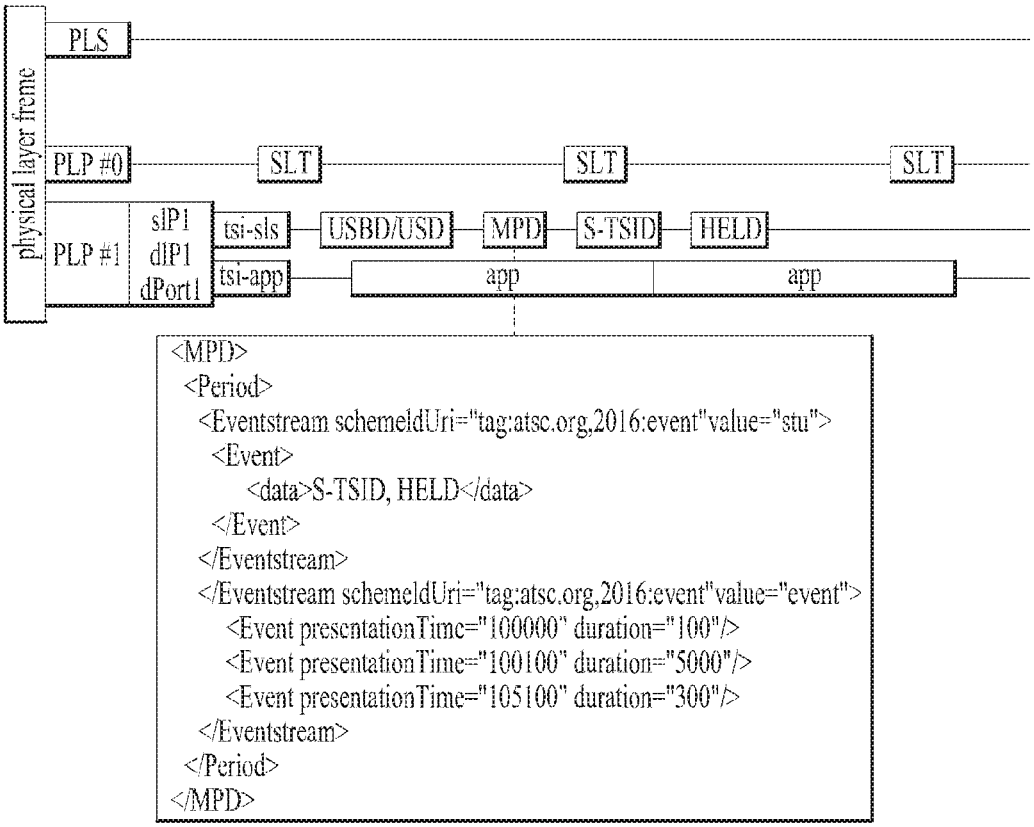
FIG. 22 is a diagram showing a usage example of an event according to an embodiment of the present invention.

FIG. 22 is a diagram showing a usage example of an event according to an embodiment of the present invention.

According to an embodiment of the present invention, an event for signaling update of a signaling table can be defined. The event may have schemeIdUri=tag:atsc.org,2016:event, and value=stu, and data may have a table name divided by a comma. For example, an EventStream element included in the Period element of MPD may have schemeIdUri=tag:atsc.org,2016:event and value=stu, and a data element under an Event element included in the EventStream may have a value of "S-TSID, HELD".

According to an embodiment of the present invention, an event for an issue of event stream API. The event may have schemeIdUri=tag:atsc.org,2016:event and value=event. For example, the EventStream element included in the Period element of MPD may have schemeIdUri=tag:atsc.org,2016:event and value=event.

Figure 23:
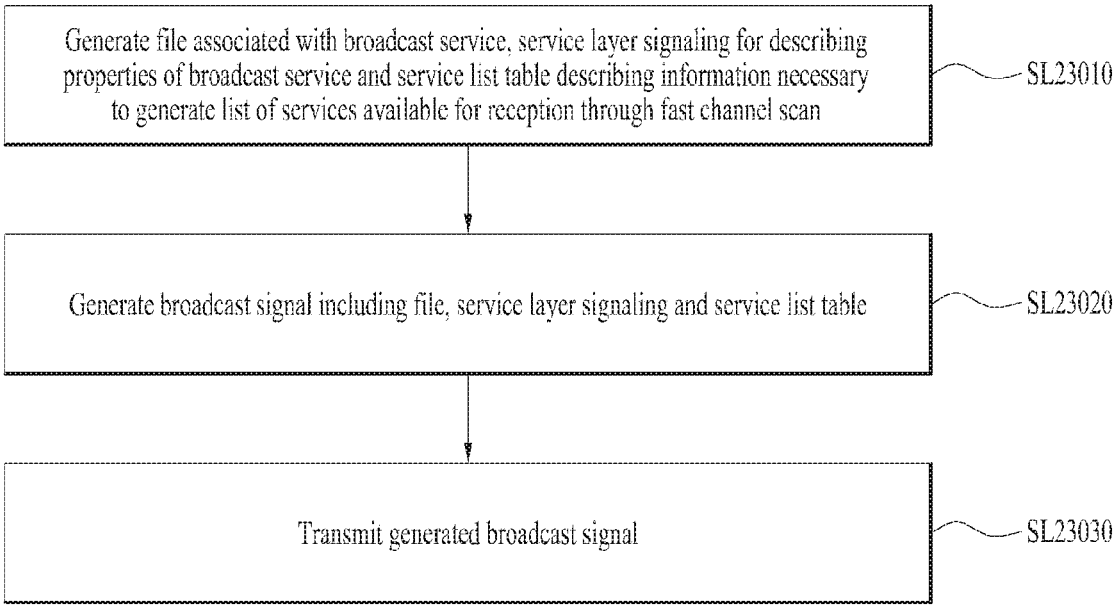
FIG. 23 is a diagram showing a method of transmitting a broadcast signal according to an embodiment of the present invention.

FIG. 23 is a diagram showing a method of transmitting a broadcast signal according to an embodiment of the present invention.

The method of transmitting a broadcast signal according to an embodiment of the present invention may include a step SL23010 of generating a file associated with a broadcast service, service layer signaling which describes properties of the broadcast service, and a service list table which describes information necessary to generate a list of services that can be received through fast channel scan, a step SL23020 of generating a broadcast signal including the file, the service layer signaling and the service list table and/or a step SL23030 of transmitting the generated broadcast signal. Here, the service layer signaling may include a distribution window description which describes information about a transmission schedule of the file associated with the broadcast service, the distribution window description may include a distribution window element which describes information about a distribution window for defining a single time interval in which the file is transmitted, the distribution window element may include a context identifier element which identifies a broadcast service for which the file transmitted during the distribution window can be used, the context identifier element may include distribution window filter code information which describes a list of filter codes indicating a personalization category of the file transmitted during the distribution window, the filter code may be used to determine a file to be downloaded during the distribution window through comparison with filter codes stored in a receiver, and the service list table may include bootstrap information for accessing an LCT (Layered Coding Transport) channel through which the service layer signaling is transmitted and service category information indicating that the broadcast service corresponds to an application based service.

According to another embodiment of the present invention, the filter code described by the distribution window filter code information may have a unique value in the range of the context identifier element.

According to another embodiment of the present invention, the file associated with the filter code may be identified by file filter code information which describes a filter code of each file in a filter delivery table.

According to another embodiment of the present invention, the service layer signaling may further include an HTML (Hyper Text Markup Language) entry page description which describes information about an HTML entry page that needs to be loaded first in order to execute the broadcast service.

According to another embodiment of the present invention, the HTML entry page description may include information indicating the URL (Uniform Resource Locator) of the HTML entry page and information indicating the URL of a package including the HTML entry page.

According to another embodiment of the present invention, the HTML entry page description may include information indicating a time when the HTML entry page is loaded and information indicating a time when the HTML entry page is unloaded.

According to another embodiment of the present invention, the HTML entry page description may include context identifier information that identifies the broadcast service, and information described in the HTML entry page description and information described in the distribution window description may be connected to each other by comparing the context identifier information with the context identifier element.

Figure 24:
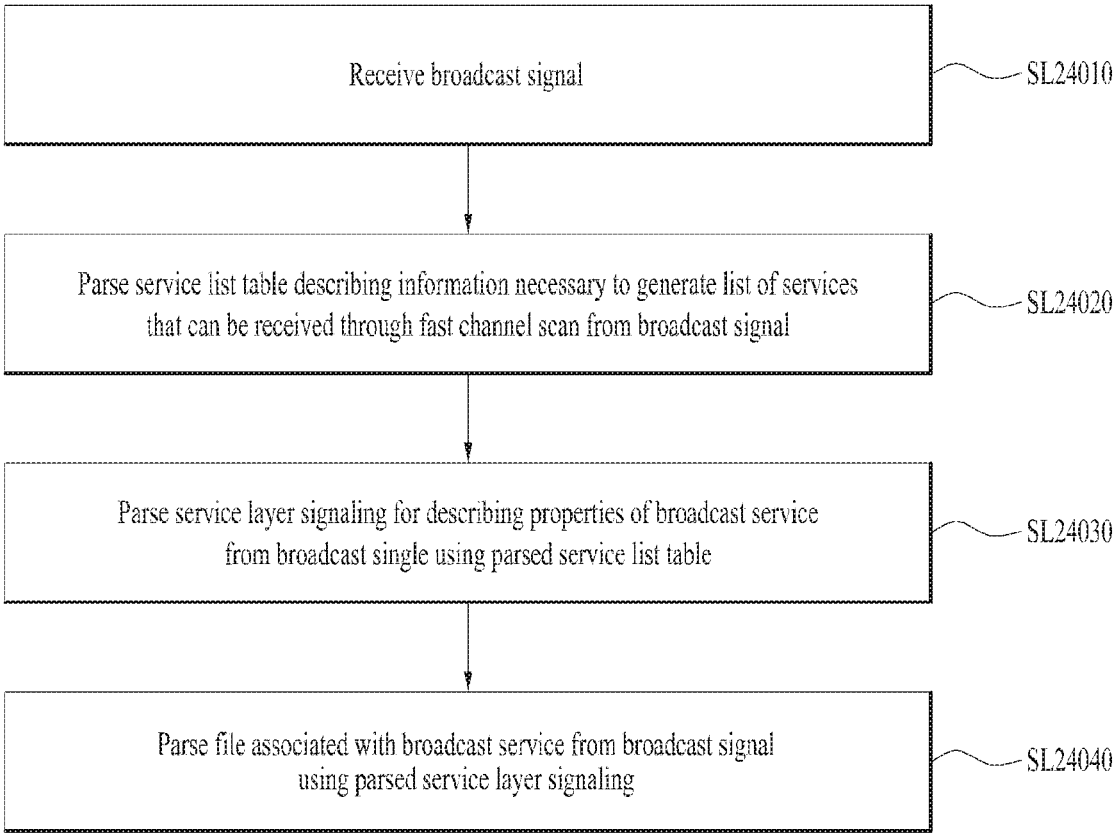
FIG. 24 is a diagram showing a method of receiving a broadcast signal according to an embodiment of the present invention.

FIG. 24 is a diagram showing a method of receiving a broadcast signal according to an embodiment of the present invention.

A method of receiving a broadcast signal according to an embodiment of the present invention may include a step SL24010 of receiving a broadcast signal, a step SL24020 of parsing a service list table which describes information necessary to generate a list of services that can be received through fast channel scan from the broadcast signal, a step SL24030 of parsing a service layer signaling which describes properties of a broadcast service from the broadcast signal using the parsed service list table and/or a step SL24040 of parsing a file associated with the broadcast service from the broadcast signal using the parsed service layer signaling. Here, the service layer signaling may include a distribution window description which describes information about a transmission schedule of the file associated with the broadcast service, the distribution window description may include a distribution window element which describes information about a distribution window for defining a single time interval in which the file is transmitted, the distribution window element may include a context identifier element which identifies a broadcast service for which the file transmitted during the distribution window can be used, the context identifier element may include distribution window filter code information which describes a list of a filter code indicating a personalization category of the file transmitted during the distribution window, the filter code may be used to determine a file to be downloaded during the distribution window through comparison with filter codes stored in a receiver, and the service list table may include bootstrap information for accessing an LCT (Layered Coding Transport) channel through which the service layer signaling is transmitted and service category information indicating that the broadcast service corresponds to an application based service.

According to another embodiment of the present invention, the filter code described by the distribution window filter code information may have a unique value in the range of the context identifier element.

According to another embodiment of the present invention, the file associated with the filter code may be identified by file filter code information which describes a filter code of each file in a filter delivery table.

According to another embodiment of the present invention, the service layer signaling may further include an HTML (Hyper Text Markup Language) entry page description which describes information about an HTML entry page that needs to be loaded first in order to execute the broadcast service.

According to another embodiment of the present invention, the HTML entry page description may include information indicating the URL (Uniform Resource Locator) of the HTML entry page and information indicating the URL of a package including the HTML entry page.

According to another embodiment of the present invention, the HTML entry page description may include information indicating a time when the HTML entry page is loaded and information indicating a time when the HTML entry page is unloaded.

According to another embodiment of the present invention, the HTML entry page description may include context identifier information that identifies the broadcast service, and information described in the HTML entry page description and information described in the distribution window description may be connected to each other by comparing the context identifier information with the context identifier element.

Figure 25:
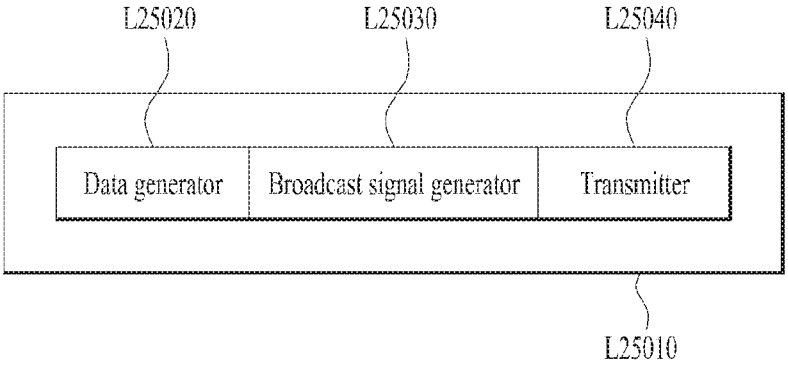
FIG. 25 is a diagram showing a configuration of a device for transmitting a broadcast signal according to an embodiment of the present invention.

FIG. 25 is a diagram showing a configuration of a device for transmitting a broadcast signal according to an embodiment of the present invention.

The device S25010 for receiving a broadcast signal according to an embodiment of the present invention may include a data generator S25020 for generating a file associated with a broadcast service, service layer signaling which describes properties of the broadcast service, and a service list table which describes information necessary to generate a list of services that can be received through fast channel scan, a broadcast signal generator L25030 for generating a broadcast signal including the file, the service layer signaling and the service list table and/or a transmitter L25040 for transmitting the generated broadcast signal. Here, the service layer signaling may include a distribution window description which describes information about a transmission schedule of the file associated with the broadcast service, the distribution window description may include a distribution window element which describes information about a distribution window for defining a single time interval in which the file is transmitted, the distribution window element may include a context identifier element which identifies a broadcast service for which the file transmitted during the distribution window can be used, the context identifier element may include distribution window filter code information which describes a list of filter codes indicating a personalization category of the file transmitted during the distribution window, the filter code may be used to determine a file to be downloaded during the distribution window through comparison with filter codes stored in a receiver, and the service list table may include bootstrap information for accessing an LCT (Layered Coding Transport) channel through which the service layer signaling is transmitted and service category information indicating that the broadcast service corresponds to an application based service.

Modules or units may be processors executing consecutive processes stored in a memory (or a storage unit). The steps described in the aforementioned embodiments can be performed by hardware/processors. Modules/blocks/units described in the above embodiments can operate as hardware/processors. The methods proposed by the present invention can be executed as code. Such code can be written on a processor-readable storage medium and thus can be read by a processor provided by an apparatus.

While the embodiments have been described with reference to respective drawings for convenience, embodiments may be combined to implement a new embodiment. In addition, designing computer-readable recording media storing programs for implementing the aforementioned embodiments is within the scope of the present invention.

The apparatus and method according to the present invention are not limited to the configurations and methods of the above-described embodiments and all or some of the embodiments may be selectively combined to obtain various modifications.

The methods proposed by the present invention may be implemented as processor-readable code stored in a processor-readable recording medium included in a network device. The processor-readable recording medium includes all kinds of recording media storing data readable by a processor. Examples of the processor-readable recording medium include a ROM, a RAM, a CD-ROM, a magnetic tape, a floppy disk, an optical data storage device and the like, and implementation as carrier waves such as transmission over the Internet. In addition, the processor-readable recording medium may be distributed to computer systems connected through a network, stored and executed as code readable in a distributed manner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Such modifications should not be individually understood from the technical spirit or prospect of the present invention.

Both an apparatus and a method inventions are mentioned in this specification and descriptions of both the apparatus and method inventions may be complementarily applied to each other.

Those skilled in the art will appreciate that the present invention may be carried out in other specific ways than those set forth herein without departing from the spirit and essential characteristics of the present invention. Therefore, the scope of the invention should be determined by the appended claims and their legal equivalents, not by the above description, and all changes coming within the meaning and equivalency range of the appended claims are intended to be embraced therein.

In the specification, both the apparatus invention and the method invention are mentioned and description of both the apparatus invention and the method invention can be applied complementarily.

MODE FOR INVENTION

Various embodiments have been described in the best mode for carrying out the invention.

INDUSTRIAL APPLICABILITY

The present invention is applied to broadcast signal providing fields.

Various equivalent modifications are possible within the spirit and scope of the present invention, as those skilled in the relevant art will recognize and appreciate. Accordingly, it is intended that the present invention cover the modifications and variations of this invention provided they come within the scope of the appended claims and their equivalents.

What is claimed is:

1. A method of transmitting a broadcast signal in a transmitter, the method comprising:

generating a file associated with a broadcast service, a distribution window description providing information for a transmission schedule of the file, and a Hyper Text Markup Language (HTML) entry page description which provides information for an entry page that needs to be loaded first in order to execute the broadcast service, wherein the HTML entry page description includes providing information for indicating a Uniform Resource Locator (URL) of the entry page of an application and information for indicating a URL of a package including the entry page, wherein the distribution window description includes a distribution window element providing information about a distribution window for defining a single time interval in which the file is transmitted, wherein the distribution window element includes a context identifier element for the file transmitted during the distribution window, wherein the context identifier element includes distribution window filter code information that is a list of filter codes for indicating a personalization category of the file transmitted during the distribution window, and wherein the filter codes are used to determine a file to be downloaded during the distribution window through comparison with filter codes stored in a receiver;

generating the broadcast signal including the file and the distribution window description; and transmitting the generated broadcast signal.

2. The method according to claim 1, wherein the filter code described by the distribution window filter code information are unique in a range of the context identifier element.

3. The method according to claim 1, wherein the file associated with the filter codes is identified by file filter code information which describes a filter code of each file in a filter delivery table.

4. The method according to claim 1, wherein the HTML entry page description further includes information for indicating a time when the entry page is loaded and information for indicating a time when the entry page is unloaded.

5. The method according to claim 1, wherein the HTML entry page description further includes context identifier information for identifying the broadcast service, and wherein information described in the HTML entry page description and information described in the distribution window description are connected to each other by comparing the context identifier information with the context identifier element.

6. A method of receiving a broadcast signal in a receiver, the method comprising:

receiving the broadcast signal;

parsing a distribution window description providing information for a transmission schedule of a file associated with a broadcast service; and receiving the file associated with the broadcast service based on the distribution window description, wherein the distribution window description includes a distribution window element providing information about a distribution window for defining a single time interval in which the file is transmitted, wherein the distribution window element includes a context identifier element for the file transmitted during the distribution window, wherein the context identifier element includes distribution window filter code information that is a list of filter codes for indicating a personalization category of the file transmitted during the distribution window, wherein the filter codes are used to determine a file to be downloaded during the distribution window through comparison with filter codes stored in the receiver, and wherein the broadcast signal further includes a Hyper Text Markup Language (HTML) entry page description which provides information for an entry page that needs to be loaded first in order to execute the broadcast service, wherein the HTML entry page description includes providing information for indicating a Uniform Resource Locator (URL) of the entry page of an application and information for indicating a URL of a package including the entry page.

7. The method according to claim 6, wherein the filter codes described by the distribution window filter code information are unique in a range of the context identifier element.

8. The method according to claim 6, wherein the file associated with the filter codes is identified by file filter code information which describes a filter code of each file in a filter delivery table.

9. The method according to claim 6, wherein the HTML entry page description further includes information for indicating a time when the entry page is loaded and information for indicating a time when the entry page is unloaded.

10. The method according to claim 6, wherein the HTML entry page description further includes context identifier information for identifying the broadcast service, and wherein information described in the HTML entry page description and information described in the distribution window description are connected to each other by comparing the context identifier information with the context identifier element.

* * * * *